US009487899B2

(12) United States Patent
Kim et al.

(10) Patent No.: US 9,487,899 B2
(45) Date of Patent: Nov. 8, 2016

(54) BALANCER OF WASHING MACHINE

(71) Applicant: SAMSUNG ELECTRONICS CO., LTD., Suwon-si, Gyeonggi-do (KR)

(72) Inventors: Min Sung Kim, Yongin-si (KR); Dong Ha Jung, Yongin-si (KR); Jeong Hoon Kang, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 104 days.

(21) Appl. No.: 14/472,450

(22) Filed: Aug. 29, 2014

(65) Prior Publication Data

US 2015/0068255 A1 Mar. 12, 2015

(30) Foreign Application Priority Data

Sep. 11, 2013 (KR) ..... 10-2013-0109028

(51) Int. Cl.
*D06F 37/22* (2006.01)

(52) U.S. Cl.
CPC ..... *D06F 37/225* (2013.01); *D06F 2222/00* (2013.01)

(58) Field of Classification Search
CPC ..... D06F 37/20; D06F 37/203; D06F 37/22; D06F 37/225; D06F 37/24; D06F 37/245; D06F 2222/00; F16F 15/363
See application file for complete search history.

(56) References Cited

U.S. PATENT DOCUMENTS 5,806,349 A * 9/1998 Kim ..... D06F 37/245 68/23.2
6,510,122 B1 * 1/2003 Yamauchi ..... G11B 17/028 369/266
2001/0038601 A1 * 11/2001 Kikuchi ..... F16F 15/363 720/701
2012/0084926 A1 * 4/2012 Lee ..... D06F 37/225 8/137
2012/0192362 A1 * 8/2012 Lee ..... D06F 37/203 8/137
2012/0278996 A1 * 11/2012 Park ..... D06F 33/02 8/137

FOREIGN PATENT DOCUMENTS

EP 0 811 717 A2 12/1997
EP 0 811 717 A3 6/1998
EP 2 441 872 A2 4/2012
EP 2 604 736 A1 6/2013
EP 2 441 872 A3 10/2014
GB 2410750 A * 8/2005 ..... D06F 37/225
WO 2005/075726 A1 8/2005

OTHER PUBLICATIONS

Extended European Search Report dated Jul. 14, 2015 in corresponding European Patent Application No. 14184287.2.

* cited by examiner

*Primary Examiner* — Joseph L Perrin
(74) *Attorney, Agent, or Firm* — Staas & Halsey LLP

(57) ABSTRACT

A balancer of a washing machine including a balancer housing mounted to a front surface of a drum and having an annular channel therein, a plurality of masses movably disposed along the channel, at least one magnet coupled to the balancer housing so as to restrict the masses from moving along the channel when a revolution per minute value of the drum is within a specific revolution per minute range, and at least one guide groove which is formed on an inner surface of the balancer housing and guides movement of the plural masses when the drum rotates.

17 Claims, 20 Drawing Sheets

BALANCER OF WASHING MACHINE

CROSS-REFERENCE TO RELATED APPLICATION

This application claims the benefit of Korean Patent Application No. 10-2013-0109028, filed on Sep. 11, 2013 in the Korean Intellectual Property Office, the disclosure of which is incorporated herein by reference.

BACKGROUND

1. Field

Embodiments of the present invention relate to a washing machine including a balancer to offset an unbalanced load caused during rotation of a drum.

2. Description of the Related Art

A washing machine is an apparatus configured to wash clothes using electricity, and generally includes a cabinet defining an external appearance of the washing machine, a tub to store wash water inside the cabinet, a drum rotatably installed inside the tub, and a motor to rotatably drive the drum.

When the drum is rotated by the motor in a state in which laundry and wash water are accommodated into the drum, the laundry rubs against the drum and the wash water so as to allow stains on the laundry to be eliminated.

If laundry is concentrated at a particular part in the drum without being evenly distributed therein during rotation of the drum, vibration and noise are generated due to eccentric rotation of the drum, and components such as the drum and the motor may even be damaged.

Accordingly, the washing machine includes a balancer to stabilize rotation of the drum by offsetting an unbalanced load caused within the drum.

SUMMARY

Therefore, it is an aspect of the present invention to provide a balancer of a washing machine having improved balancing performance.

Additional aspects of the invention will be set forth in part in the description which follows and, in part, will be obvious from the description, or may be learned by practice of the invention.

In accordance with one aspect of the present invention, a balancer mounted to a drum of a washing machine to offset an unbalanced load caused within the drum during rotation of the drum, includes a balancer housing which is mounted to a front surface of the drum and has an annular channel therein, a plurality of masses movably disposed along the channel, at least one magnet coupled to an outer surface of the balancer housing so as to restrict the masses from moving along the channel when an RPM of the drum is within a specific RPM range, and at least one guide groove which is formed on an inner surface of the balancer housing and guides movement of the plural masses when the drum rotates.

The balancer housing may include a first housing opened at one side thereof, and a second housing covering the first housing to form the annular channel.

The at least one guide groove may include a first guide groove formed on an inner surface of the first housing.

The at least one guide groove may include a second guide groove formed on an inner surface of the second housing.

A vertical distance between a first line, which is parallel with an axis of rotation of the drum and passes through a center of the first guide groove, and the axis of rotation of the drum may be greater than a vertical distance between a second line, which is parallel with the axis of rotation of the drum and passes through a center of the second guide groove, and the axis of rotation of the drum.

The first guide groove may be formed along a circumferential direction of the balancer housing.

The second guide groove may be formed along a circumferential direction of the balancer housing.

The first and second guide grooves may be arranged to face each other.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
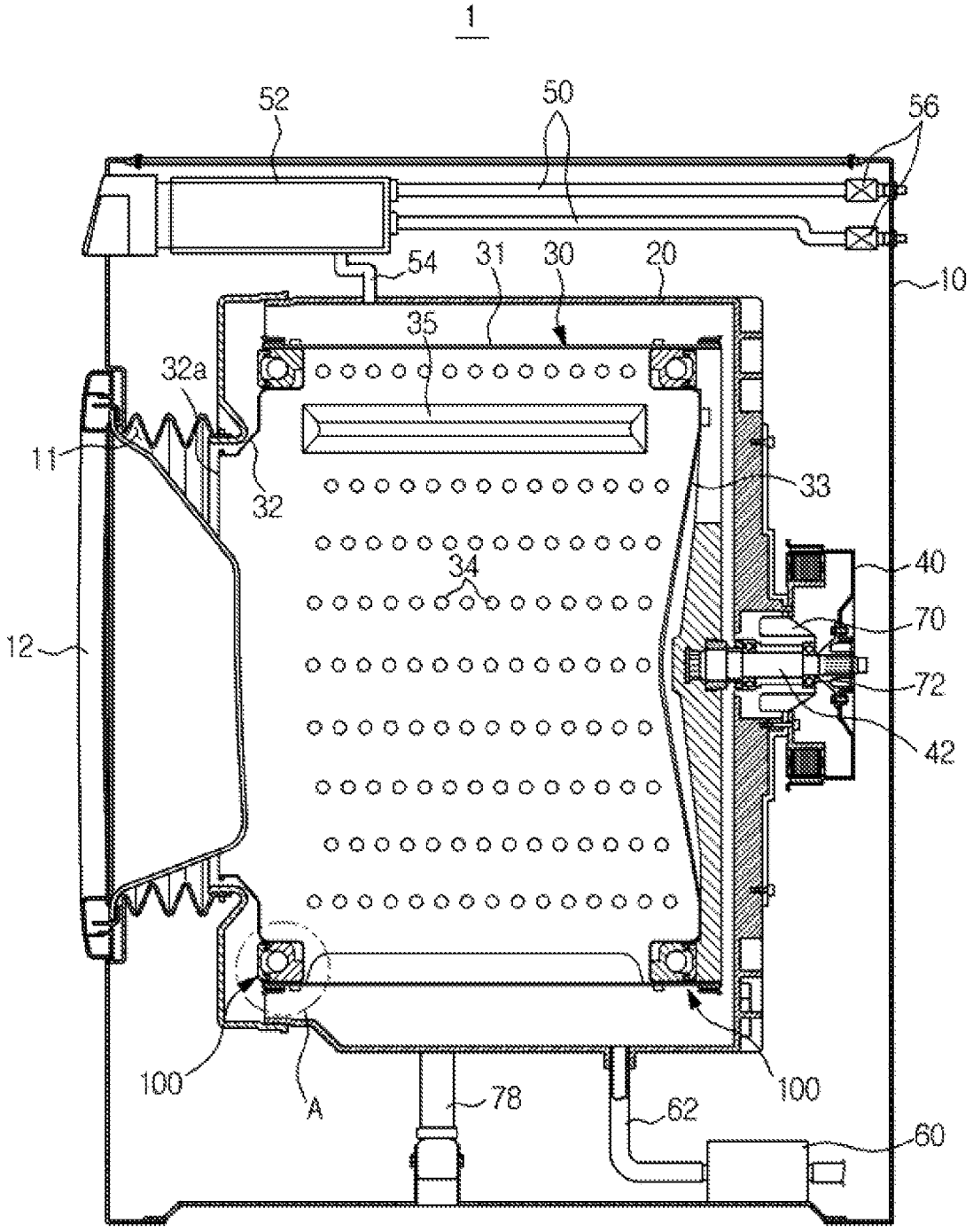
FIG. 1 is a view illustrating a configuration of a washing machine according to an embodiment of the present invention.

Reference will now be made in detail to the embodiments of the present invention, examples of which are illustrated in the accompanying drawings, wherein like reference numerals refer to like elements throughout.

FIG. 1 is a view illustrating a configuration of a washing machine according to an embodiment of the present invention.

As shown in FIG. 1, a washing machine 1 includes a cabinet 10 defining an external appearance thereof, a tub 20 arranged within the cabinet 10, a drum 30 rotatably arranged within the tub 20, and a motor 40 to drive the drum 30.

The cabinet 10 is formed, at a front surface portion thereof, with an opening 11 through which laundry may be inserted into the drum 30. The opening 11 is opened and closed by a door 12 mounted to the front surface portion of the cabinet 10.

The tub 20 is equipped, at an upper portion thereof, with water supply tubes 50 to supply wash water to the tub 20. Each of the water supply tubes 50 is connected, at one side thereof, with a water supply valve 56 and the other sides of the water supply tubes 50 are connected with a detergent supply unit 52.

The detergent supply unit 52 is connected to the tub 20 through a connection tube 54. Water supplied through the water supply tubes 50 is supplied into the tub 20 together with detergent via the detergent supply unit 52.

The tub 20 is equipped, at a lower portion thereof, with a drainage pump 60 and a drainage tube 62 to discharge water within the tub 20 to the outside of the cabinet 10.

The drum 30 includes a cylindrical portion 31, a front wall 32 disposed in the front of the cylindrical portion 31, and a rear wall 33 disposed in the rear of the cylindrical portion 31. The front wall 32 is formed with an opening 32*a* for insertion of laundry, and the rear wall 33 is connected to a drive shaft 42 to which the motor 40 transmits power.

A plurality of through holes 34, through which wash water passes, is formed around the drum 30, and a plurality of lifters 35 is installed on an inner peripheral surface of the drum 30 so that laundry may be tumbled during rotation of the drum 30.

The drive shaft 42 is disposed between the drum 30 and the motor 40. One end of the drive shaft 42 is connected to the rear wall 33 of the drum 30, and the other end of the drive shaft 42 extends outward of a rear wall of the tub 20. When the motor 40 drives the drive shaft 42, the drum 30 connected to the drive shaft 42 rotates about the drive shaft 42.

The rear wall of the tub 20 is provided with a bearing housing 70 to rotatably support the drive shaft 42. The bearing housing 70 may be made of an aluminum alloy, and be inserted into the rear wall of the tub 20 during injection molding of the tub 20. Bearings 72 are installed between the bearing housing 70 and the drive shaft 42 so that the drive shaft 42 may be smoothly rotated.

The tub 20 is supported by a damper 78. The damper 78 connects an inside bottom surface of the cabinet 10 to an outer surface of the tub 20.

During a washing operation, the motor 40 rotates the drum 30 at low speed in forward and reverse directions, and thus stains on laundry are eliminated while the laundry within the drum 30 is continuously tumbled.

During a dehydration operation, when the motor 40 rotates the drum 30 at high speed in one direction, water is separated from laundry by centrifugal force acting on the laundry.

In the process of dehydration, when laundry is concentrated at a particular part in the drum 30 without being evenly distributed therein during rotation of the drum 30, the drum 30 unstably rotates, resulting in vibration and noise.

Accordingly, the washing machine 1 includes a balancer 100 to stabilize rotational motion of the drum 30.

Figure 2:
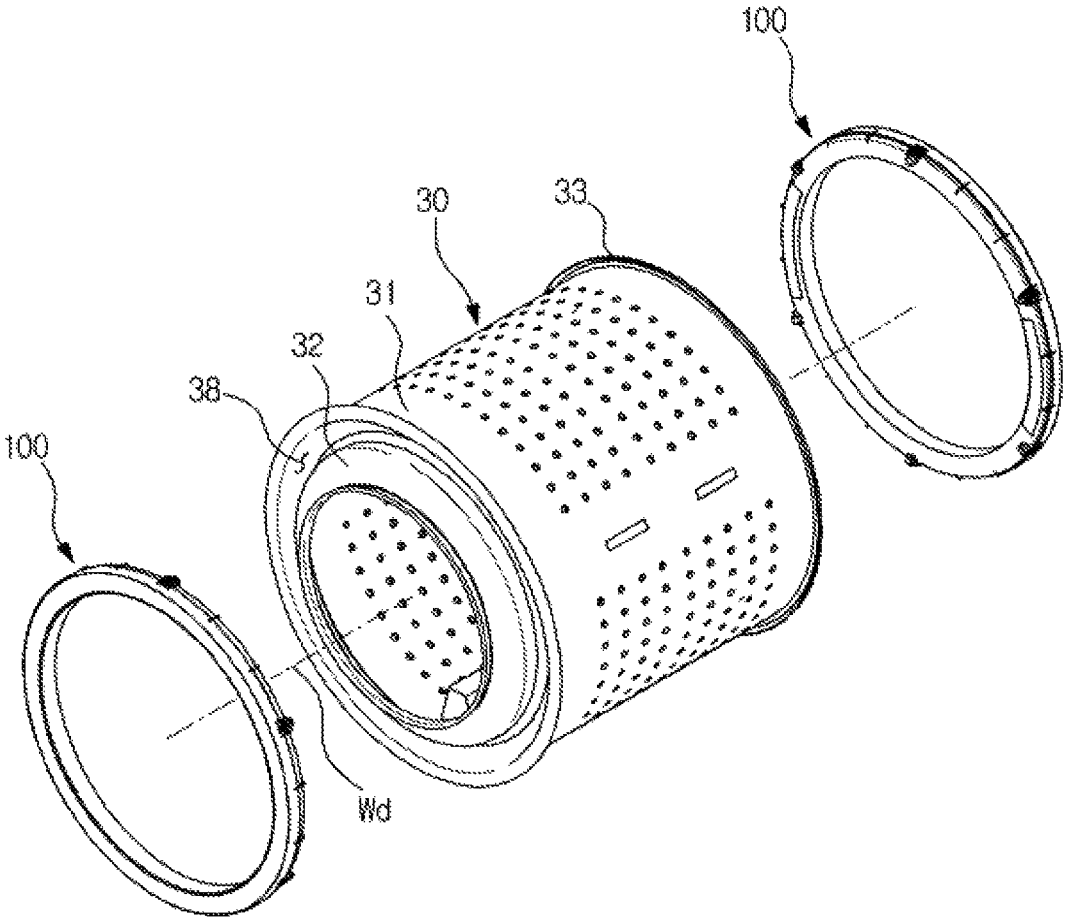
FIG. 2 is an exploded perspective view of a drum and a balancer according to an embodiment of the present invention.
Figure 3:
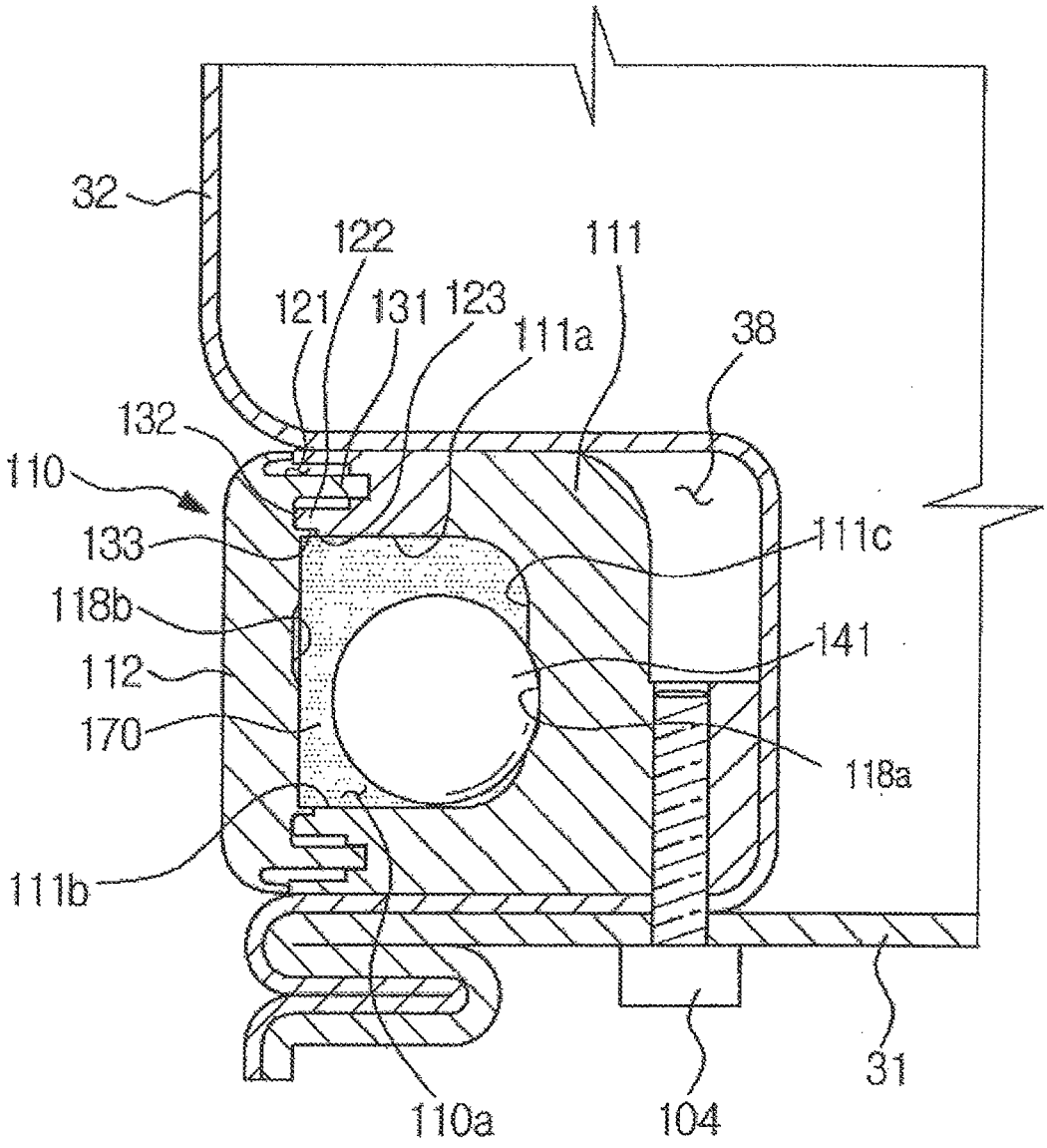
FIG. 3 is an enlarged view of portion "A" in FIG. 1.
Figure 4:
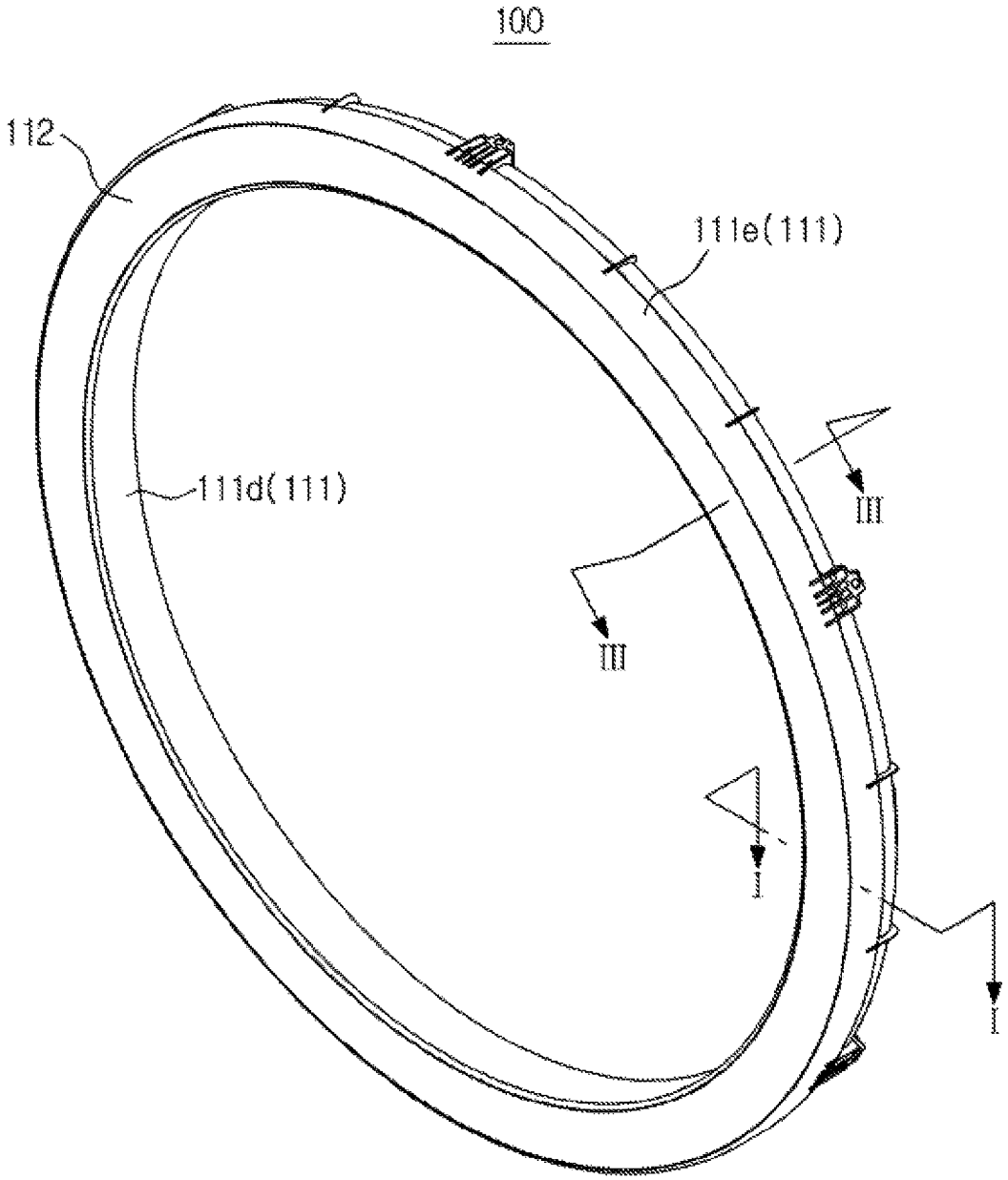
FIG. 4 is a perspective view illustrating the balancer according to the embodiment of the present invention.
Figure 5:
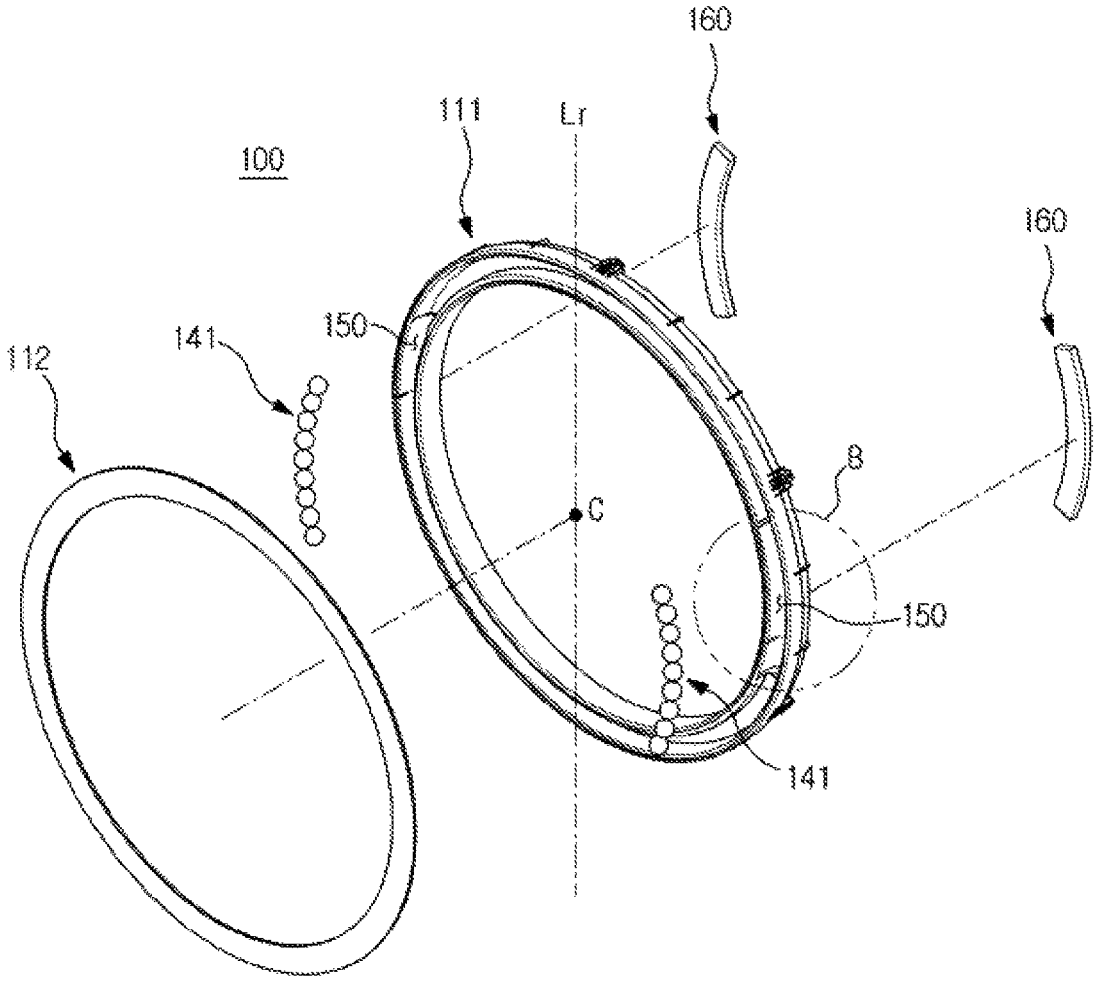
FIG. 5 is an exploded perspective view of the balancer shown in FIG. 4.
Figure 6:
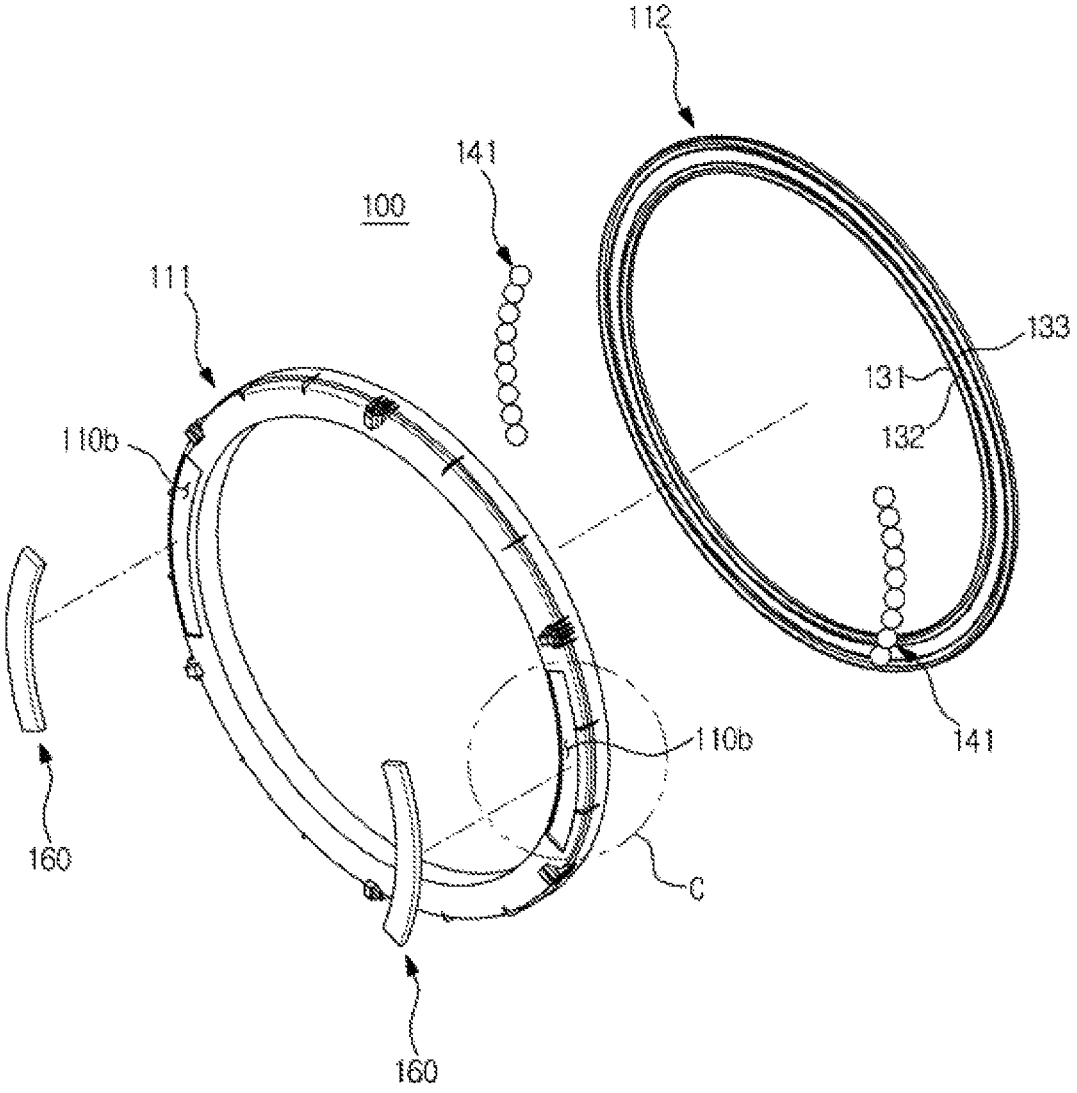
FIG. 6 is an exploded perspective view of the balancer in FIG. 5 when viewed from another angle.
Figure 7:
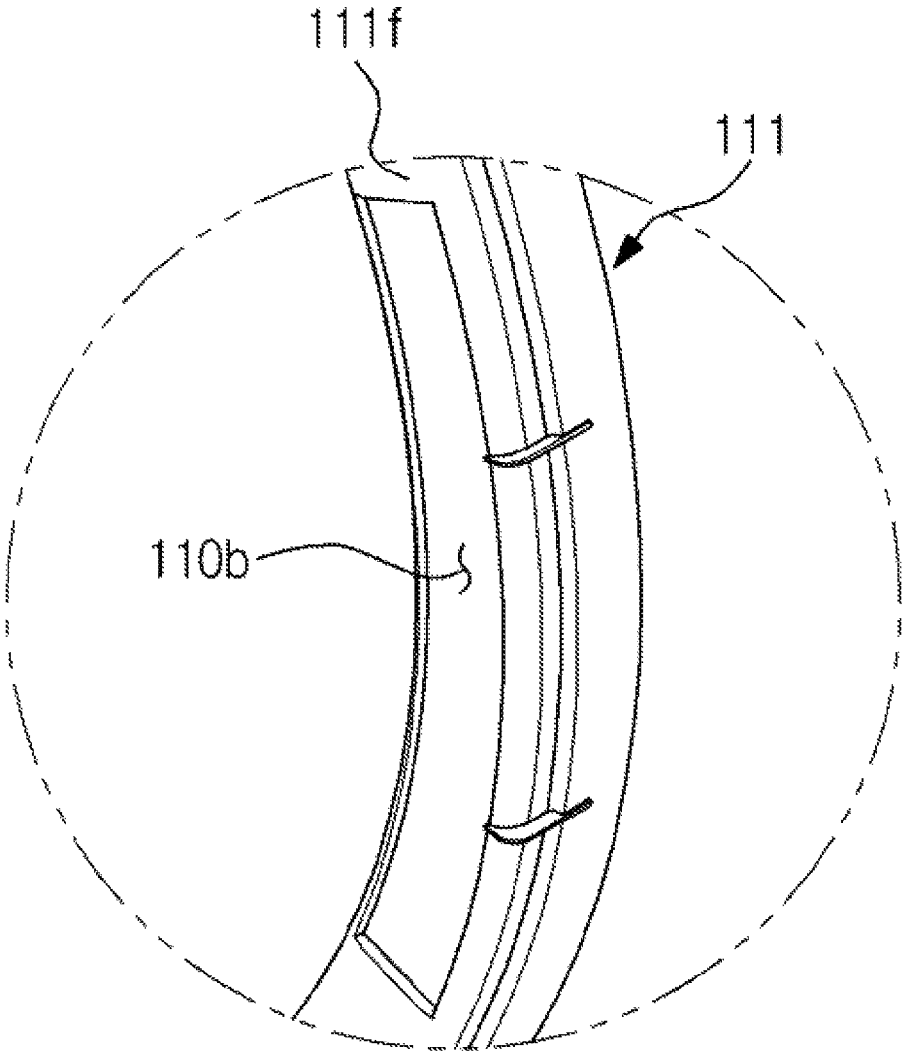
FIG. 7 is an enlarged view of portion "C" in FIG. 6.
Figure 8:
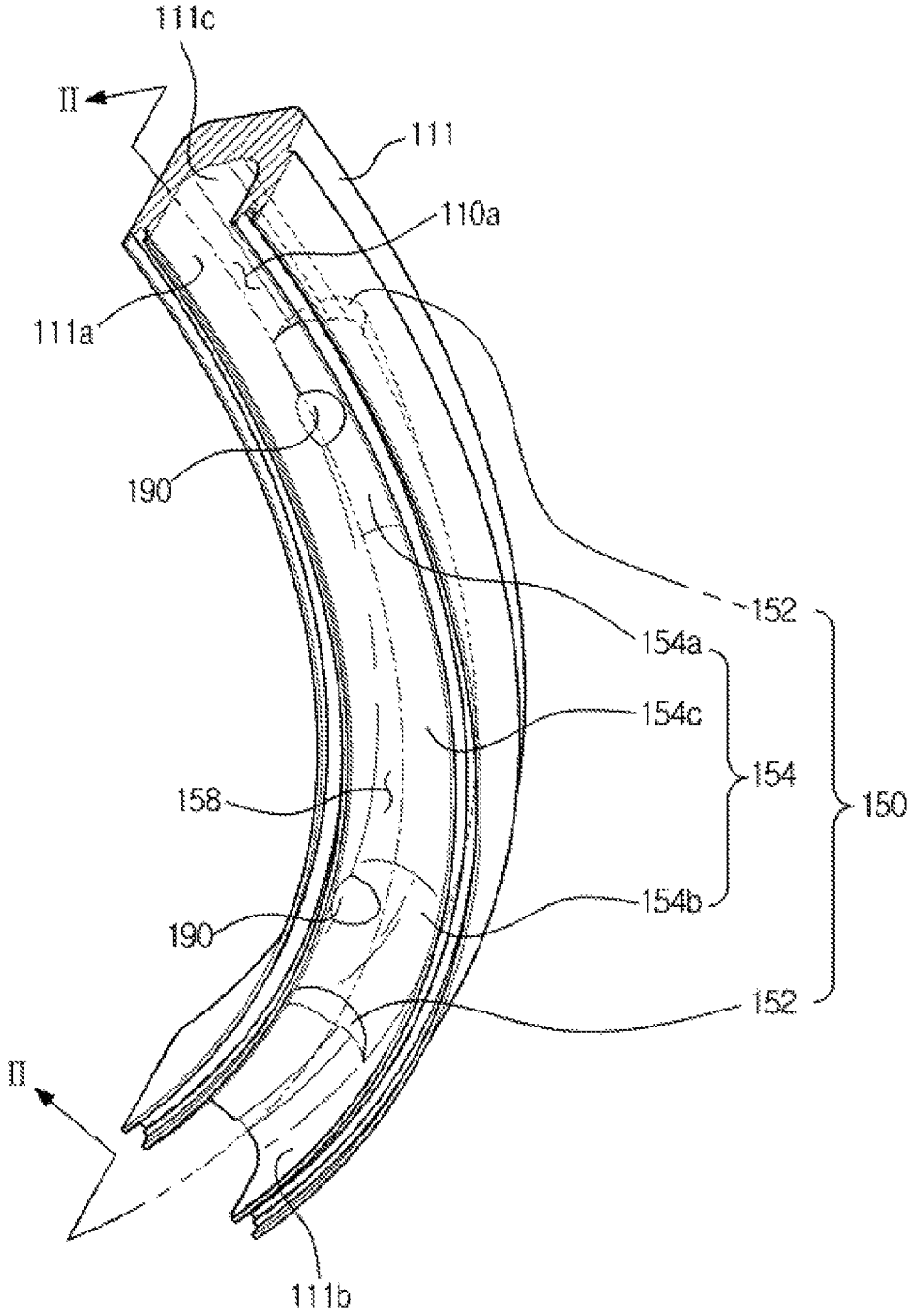
FIG. 8 is an enlarged view of portion "B" in FIG. 5.
Figure 9:
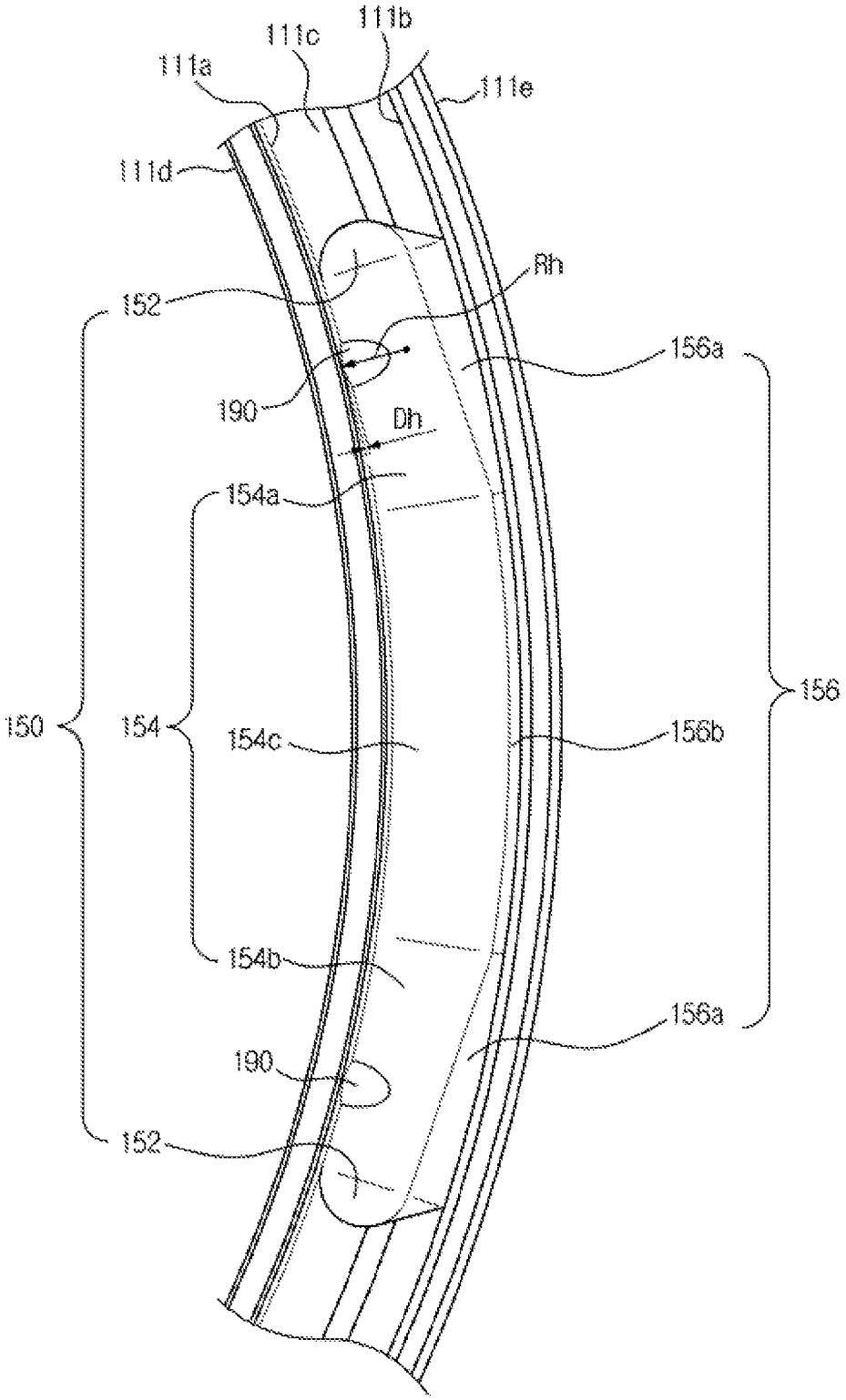
FIG. 9 is a front view of FIG. 8.
Figure 10:
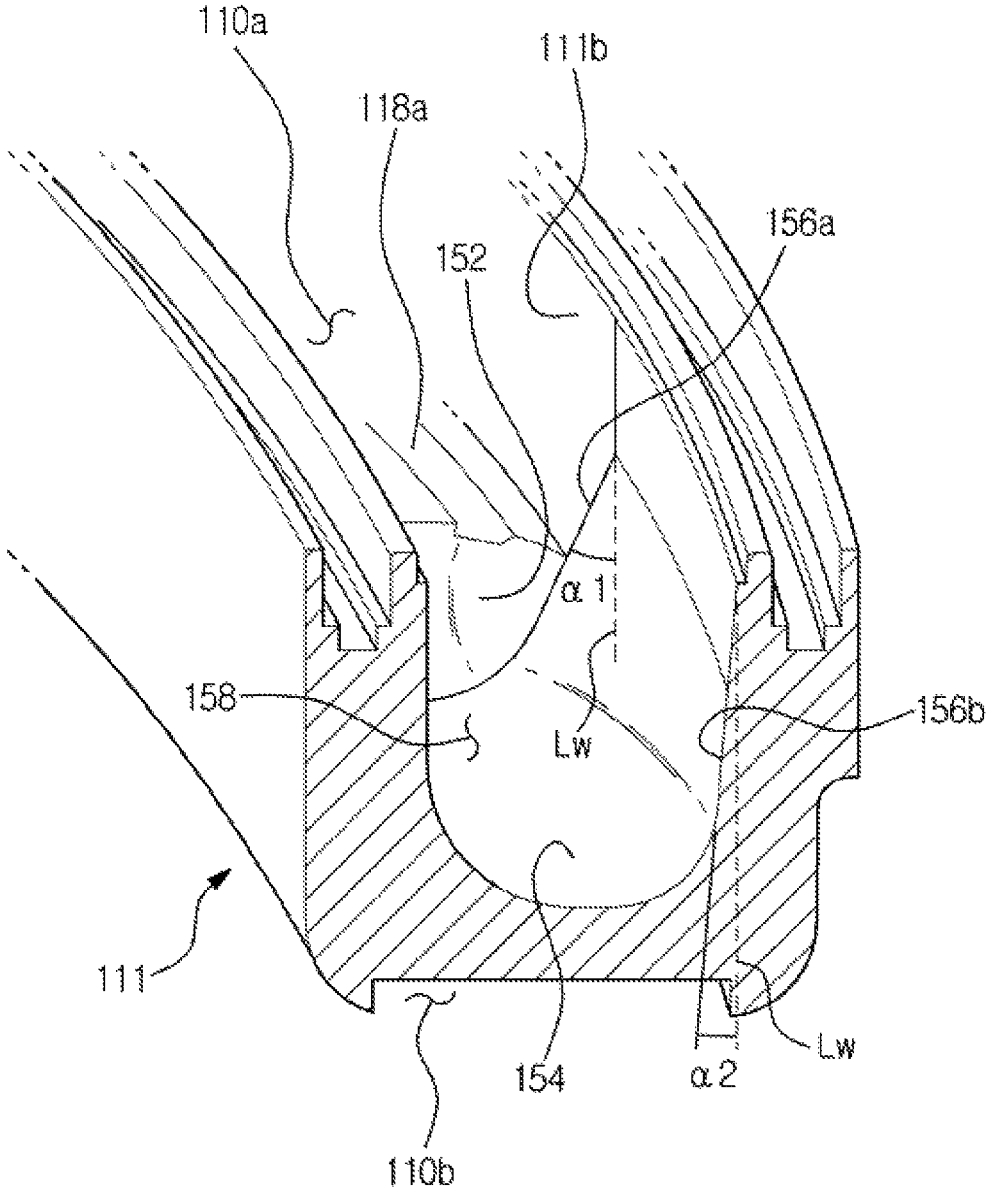
FIG. 10 is an enlarged view illustrating an inclined sidewall.
Figure 11:
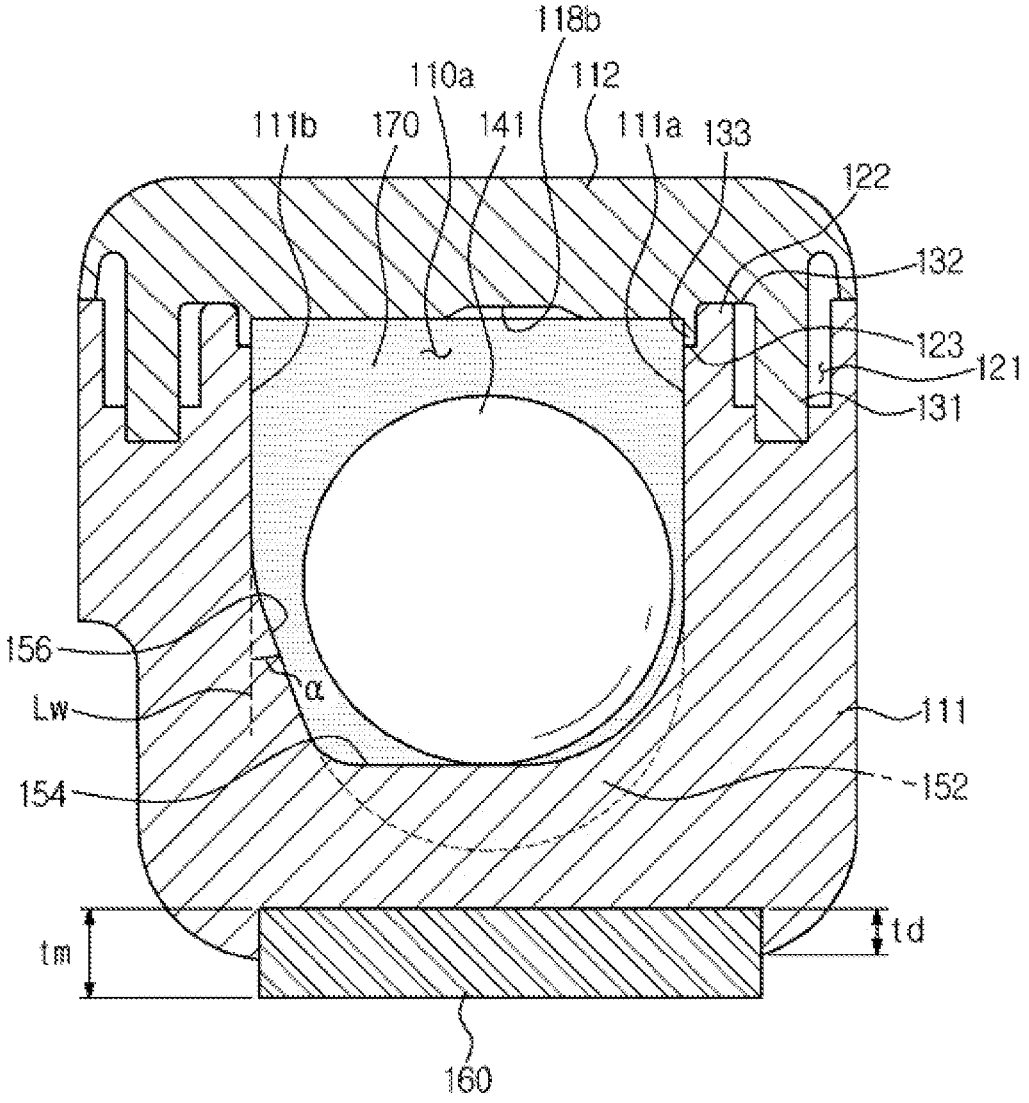
FIG. 11 is a cross-sectional view taken along line I-I in FIG. 4.
Figure 12:
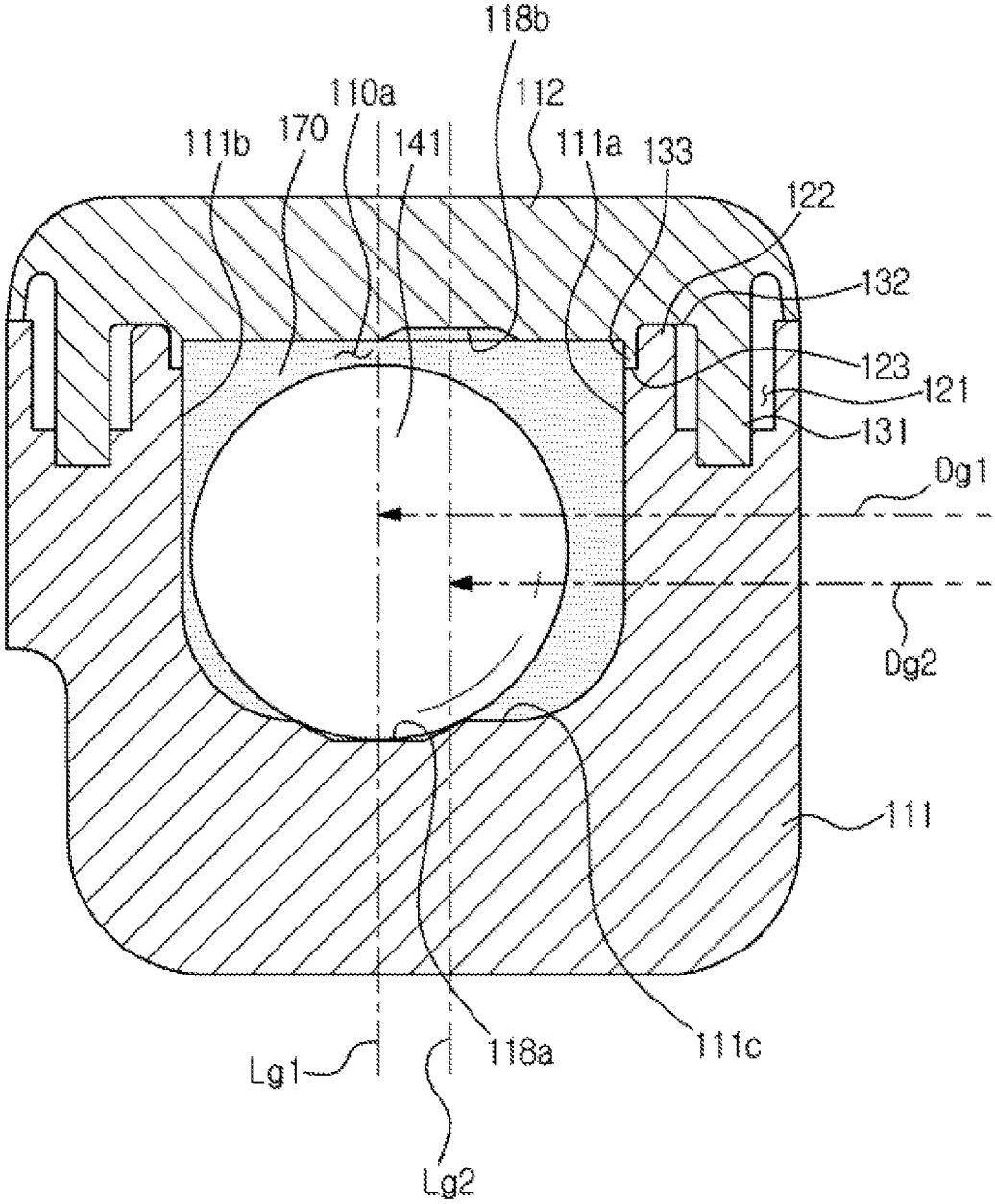
FIG. 12 is a cross-sectional view taken along line III-III in FIG. 4.
Figure 13:
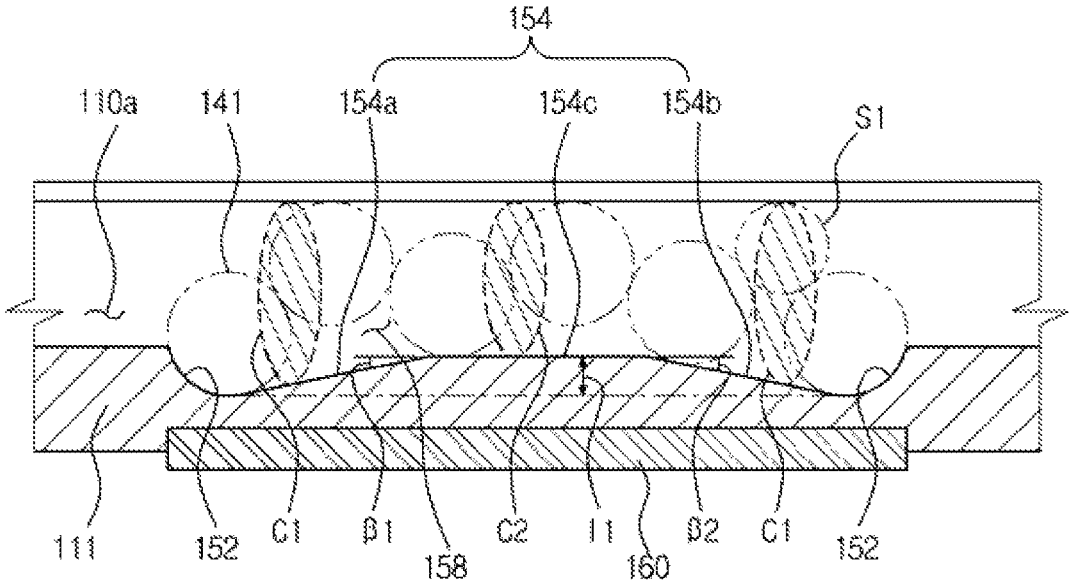
FIG. 13 is a cross-sectional view taken along line II-II in FIG. 8.

FIG. 2 is an exploded perspective view of the drum and the balancer according to an embodiment of the present invention. FIG. 3 is an enlarged view of portion "A" in FIG. 1. FIG. 4 is a perspective view illustrating the balancer according to an embodiment of the present invention. FIG. 5 is an exploded perspective view of the balancer shown in FIG. 4. FIG. 6 is an exploded perspective view of the balancer in FIG. 5 when viewed from another angle. FIG. 7 is an enlarged view of portion "C" in FIG. 6. FIG. 8 is an enlarged view of portion "B" in FIG. 5. FIG. 9 is a front view of FIG. 8. FIG. 10 is an enlarged view illustrating an inclined sidewall. FIG. 11 is a cross-sectional view taken along line I-I in FIG. 4. FIG. 12 is a cross-sectional view taken along line III-Ill in FIG. 4. FIG. 13 is a cross-sectional view taken along line II-II in FIG. 8.

The balancer 100 may be mounted to at least one of the front wall 32 and the rear wall 33 of the drum 30. Since the balancers 100 mounted to the front wall 32 and the rear wall 33 are the same, a description will be given on the basis of the balancer 100 mounted to the front surface plate 32 below.

As shown in FIGS. 1 to 13, the balancer 100 includes a balancer housing 110 having an annular channel 110*a*, and a plurality of masses 141 arranged in the annular channel 110*a* and performing a balancing function of the drum 30 while moving along the annular channel 110*a*.

The front wall 32 of the drum 30 is formed with an annular recess 38 opened at the front thereof, and the balancer housing 110 is accommodated in the recess 38. The balancer housing 110 may be coupled to the drum 30 through a fixing member 104 so as to be securely fixed to the drum 30.

The balancer housing 110 includes an annular first housing 111 opened at one side thereof, and a second housing 112 to cover an open portion of the first housing 111. The annular channel 110*a* is defined by an inner surface of the first housing 111 and an inner surface of the second housing 112. The first and second housings 111 and 112 may be made of a plastic material such as PP (polypropylene) or an ABS (acrylonitrile butadiene styrene) resin by injection molding, and may be coupled to each other via thermal bonding. Hereinafter, a front surface of the balancer housing 110 is defined as a surface exposed to the front thereof when the balancer housing 110 is coupled to the drum 30, a rear surface of the balancer housing 110 is defined as a surface which is opposite the front surface of the balancer housing 110 and faces the front wall 32 of the drum 30 when the balancer housing 110 is coupled to the drum 30, and a side surface of the balancer housing 110 is defined as a surface which connects the front and rear surfaces of the balancer housing 110.

The first housing 111 has first coupling grooves 121 formed at both sides of the channel 110*a*, and the second housing 112 has a first coupling protrusion 131 coupled to each of the first coupling grooves 121. A second coupling protrusion 122 is formed between the first coupling groove 121 of the first housing 111 and the channel 110*a*. The second coupling protrusion 122 of the first housing 111 is coupled to a second coupling groove 132 formed at an inner side of the first coupling protrusion 131 of the second housing 112. A third coupling groove 123 is formed on an inside surface of the second coupling protrusion 122 adjacent to the channel 110*a*, and the second housing 112 has a third coupling protrusion 133 coupled to the third coupling groove 123. According to such a coupling structure, the first housing 111 may be securely coupled to the second housing 112, and when a fluid such as oil is accommodated into the channel 110*a*, it may be possible to prevent leakage of the fluid.

The first housing 111 includes first and second inner surfaces 111*a* and 111*b* facing each other, and a third inner surface 111*c* connecting the first and second inner surfaces 111*a* and 111*b*. The first inner surface 111*a* is a surface corresponding to an inner peripheral surface 111*d* of the first housing 111, and the second inner surface 111*b* is a surface corresponding to an outer peripheral surface 111*e* of the first housing 111.

Grooves 150, on which the plural masses 141 are seated to temporarily restrict the masses 141, are formed on at least one of the first, second, and third inner surfaces 111*a*, 111*b*, and 111*c*. Although FIGS. 8 and 9 show a state in which one groove 150 is formed across the first and third inner surfaces 111*a* and 111*c*, the present invention is not limited thereto. For example, the groove 150 may also be formed on at least one of the first, second, and third inner surfaces 111*a*, 111*b*, and 111*c*, formed across the first and third inner surfaces 111*a* and 111*c*, or formed across all of the first, second, and third inner surfaces 111*a*, 111*b*, and 111*c*.

The grooves 150 may be symmetrically arranged on the basis of an imaginary line Lr which passes through a center of rotation of the drum 30 and is perpendicular to the ground so as not to cause an unbalanced load on the drum 30 due to the masses 141 in a state in which the masses 141 are seated on and received in the grooves 150.

As shown particularly in FIG. 13, each of the grooves 150 is elongated in a circumferential direction of the balancer housing 110 so as to receive at least two masses 141. The groove 150 includes first support portions 152 to support the masses 141 in the substantially circumferential and radial directions of the balancer housing 110, a second support portion 154 provided between the first support portions 152 to support the masses 141 in the substantially radial direction of the balancer housing 110, inclined surfaces 154*a* and 154*b* which are obliquely formed inward of the channel 110*a* of the balancer housing 110, and at least one flat surface 154*c* provided between the inclined surfaces 154*a* and 154*b*.

The first support portions 152 are provided in a stepped shape at both ends of the groove 150 in order to prevent decoupling of the masses 141 from the groove 150 when an RPM of the drum 30 is within a specific RPM range.

The second support portion 154 is provided in a shape protruding inward of the channel 110*a*, and the inclined surfaces 154*a* and 154*b* and the flat surface 154*c* are provided in the second support portion 154. The inclined surfaces 154*a* and 154*b* include a first inclined surface 154*a* and a second inclined surface 154*b* with the flat surface 154*c* being interposed therebetween, and both ends of each of the first and second inclined surfaces 154*a* and 154*b* are respectively connected with each first support portion 152 and the flat surface 154*c*. A first inclined angle β1 defined by the flat surface 154*c* and the first inclined surface 154*a* may differ from a second inclined angle β2 defined by the flat surface 154*c* and the second inclined surface 154*b*. The second support portion 154 may have a length 11 between 1 mm and 3 mm protruding inward of the channel.

The channel 110*a* includes a cross-section increasing portion 158 having an increased cross-section at a section formed with the groove 150. The cross-section increasing portion 158 is a space formed in the channel 110*a* by the groove 150. The cross-section increasing portion 158 may be provided in a shape corresponding to at least a portion of the masses 141, and be elongated in the circumferential direction of the balancer housing 110 so as to receive at least two masses 141 similarly to the groove 150. In addition, the cross-section increasing portions 158 may be symmetrically arranged on the basis of the imaginary line Lr passing through the center of rotation of the drum 30.

Due to the first inclined surface 154*a*, the second inclined surface 154*b*, and the flat surface 154*c* provided in the second support portion 154, each cross-sectional area C1 of both ends of the cross-section increasing portion 158 is greater than a cross-sectional area C2 between both ends of the cross-section increasing portion 158.

The second support portion 154 is provided in a shape protruding inward of the channel 110*a*, and therefore a clearance S1 is generated between the masses 141 received within the groove 150 or the cross-section increasing portion 158. Accordingly, since the masses 141 are smoothly decoupled from the groove 150 without being fixed to the groove 150 when the RPM of the drum 30 departs from a specific RPM range, a balancing function of the drum 30 may be performed while the masses 141 move along the channel 110*a*.

As shown in FIGS. 8 and 9, the balancer housing 110 is provided therein with a plurality of anti-decoupling grooves 190.

The anti-decoupling grooves 190 may be formed across a portion of the groove 150 and the first inner surfaces 111*a* connected to the groove 150 or be provided in a pair at positions adjacent to the first support portions 152 of the groove 150.

A portion of each anti-decoupling groove 190 is provided in an arc shape. The anti-decoupling groove 190 may have a radius Rh equal to or more than that of the mass 141. In addition, the anti-decoupling groove 190 may have a depth Dh formed approximately between 1 mm and 2 mm from the first inner surface 111*a*.

The anti-decoupling groove 190 serves to prevent the masses 141 received in the groove 150 from being decoupled from the groove 150 at the initial stage of dehydration.

Before dehydration begins, i.e., before the drum 30 begins to rotate, the masses 141 are arranged at the bottom of the balancer housing 110 by weight thereof. In such a state, when the drum 30 rotates at low speed at the initial stage of dehydration, the masses 141 move along the channel 110*a* of the balancer housing 110 by centrifugal force, and are received in and seated on the groove 150 in the process of moving along the channel 110*a* of the balancer housing 110 (see FIGS. 15 to 17). In this case, the same number of masses 141 has to be evenly distributed in a pair of grooves 150*a* and 150*b*, respectively (see FIGS. 15 to 17).

Figure 18A:
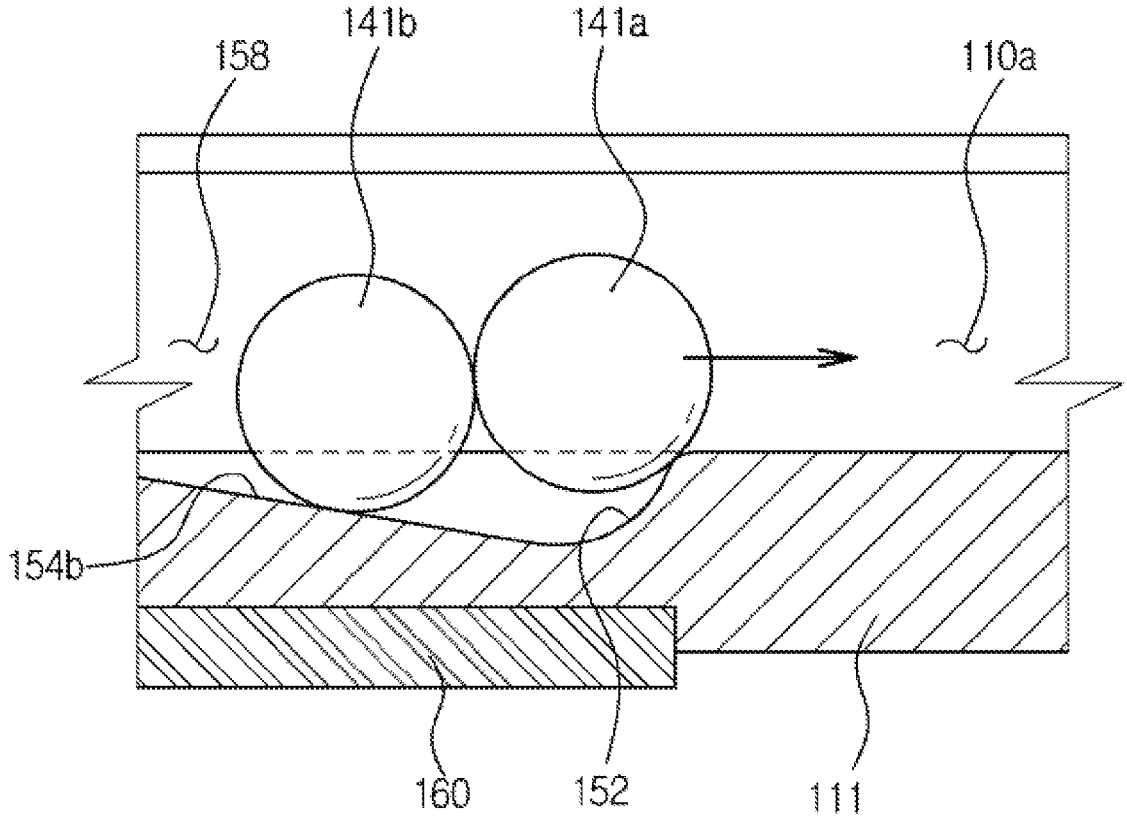
FIGS. 18*a-c* show a plurality of masses in various stages of movement relative to a channel.

As shown in FIG. 18A, in the process in which the masses 141 are received in the groove 150, a mass 141*a* (hereinafter, referred to as "outermost mass") disposed at the outermost portion of the groove 150 may be arranged in a posture where the outermost mass 141*a* is not instantaneously and fully received in the groove 150 and is slightly laid on another adjacent mass 141*b* (hereinafter, referred to as "adjacent mass") and the first support portion 152 within the groove 150. In this case, magnetic force of a magnet 160 acting on the outermost mass 141*a* is weak and support force to support the outermost mass 141*a* by the first support portion 152 is weak. Therefore, the outermost mass 141*a* may be decoupled from the groove 150 without being received therein by centrifugal force due to accelerated rotation of the drum 30.

Figure 18B:
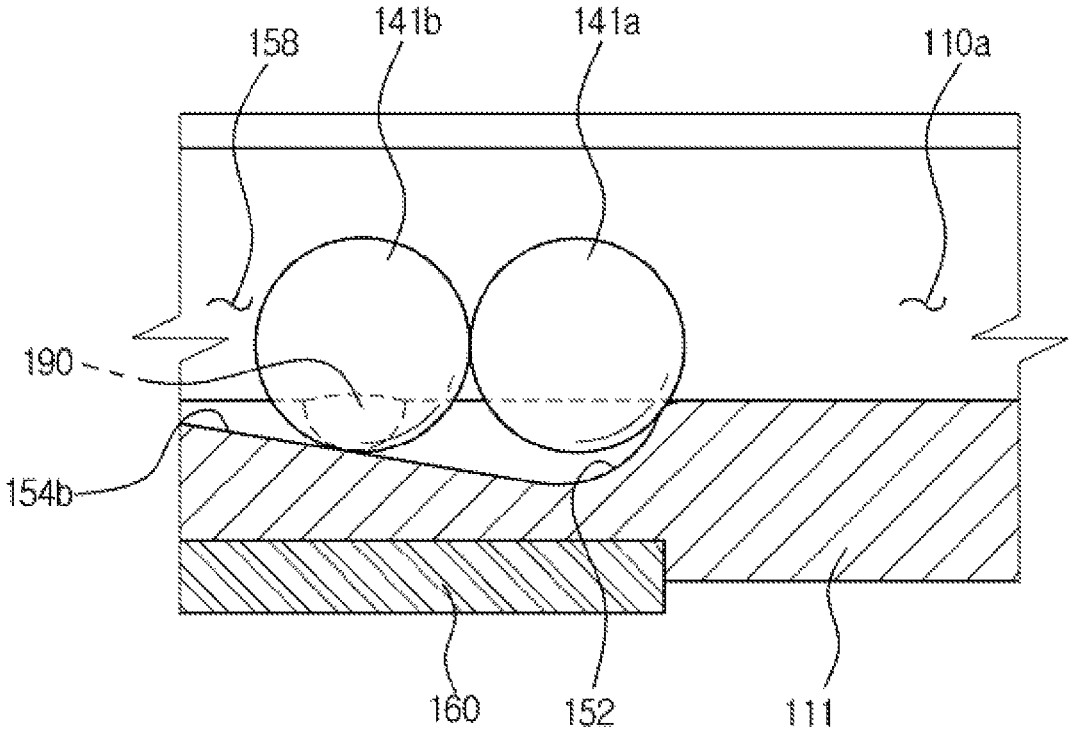
Figure 18C:
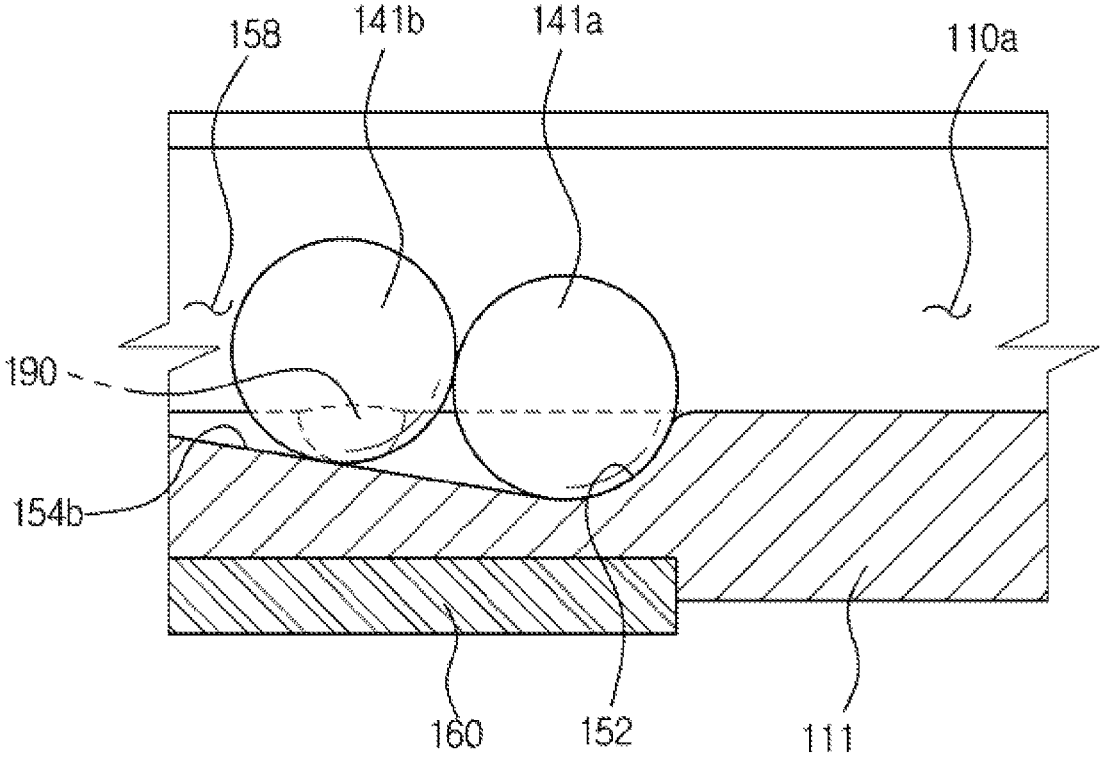

As shown in FIG. 18B, in the process in which the masses 141 are received in the groove 150 at the initial stage of dehydration, the anti-decoupling groove 190 temporarily receives the adjacent mass 141*b* and enables the outermost mass 141*a* to be supported between the first support portion 152 and the adjacent mass 141*b*. Consequently, the anti-decoupling groove 190 prevents the outermost mass 141*a* from being decoupled from the groove 150 by centrifugal force due to accelerated rotation of the drum 30. As shown in FIG. 18C, when the drum 30 is further accelerated, the outermost mass 141*a* is fully seated on and received in the groove 150 by pushing out the adjacent mass 141*b* from the anti-decoupling groove 190.

A rear surface 111*f* of the first housing 111 corresponding to the inner surface thereof formed with the groove 150 is provided with a magnet receiving groove 110*b* to receive and couple the magnet 160. The magnet receiving groove 110*b* may be provided in a shape corresponding to the magnet 160 such that the magnet 160 is coupled to the magnet receiving groove 110*b*. A depth td of the magnet receiving groove 110*b* may be equal to or less than a thickness tm of the magnet 160.

The magnet 160 is formed in an arc shape, and restricts the masses 141 such that no mass 141, which is coupled to the magnet receiving groove 110*b* and received in the groove 150, is decoupled from the groove 150.

The magnet 160 may be fixed to the magnet receiving groove 110*b* using an adhesive (not shown) and the like. After a worker applies an adhesive to the magnet receiving groove 110*b*, the magnet 160 may be inserted into and fixed to the magnet receiving groove 110*b*.

The magnet 160 is not limited to being coupled to the rear surface of the balancer housing 110. For example, the magnet 160 may also be coupled to the front surface of the balancer housing 110 or the side surface connecting the front and rear surfaces of the balancer housing 110.

The magnet 160 restricts the masses 141 using magnetic force, and an intensity of magnetic force of the magnet 160 is determined depending upon an RPM of the drum 30 when the masses 141 are decoupled from the groove 150. For instance, in order for the RPM of the drum 30 to become 200 RPM when the masses 141 are decoupled from the groove 150, the intensity of magnetic force of the magnet 160 may be adjusted in such a manner that the masses 141 are restricted so that no mass 141 received in the groove 150 is decoupled from the groove 50 when the RPM of the drum 30 is from 0 to 200 RPM, and the masses 141 are decoupled from the groove 150 when the RPM of the drum 30 exceeds 200 RPM. The intensity of magnetic force of the magnet 160 may be adjusted to a desired intensity by the size of the magnet 160, the number of the magnets 160, the magnetization method of the magnets 160, or the like.

An inclined sidewall 156 is provided on the second inner surface 111*b* corresponding to the first inner surface 111*a*.

The inclined sidewall 156 is configured of at least a portion of the second inner surface 111*b* connecting with groove 150. The inclined sidewall 156 forms an inclined angle α with an imaginary line Lw alongside of an axis Wd of rotation of the drum 30, and supports the masses 141 received in the groove 150 when the drum 30 rotates.

Figure 14:
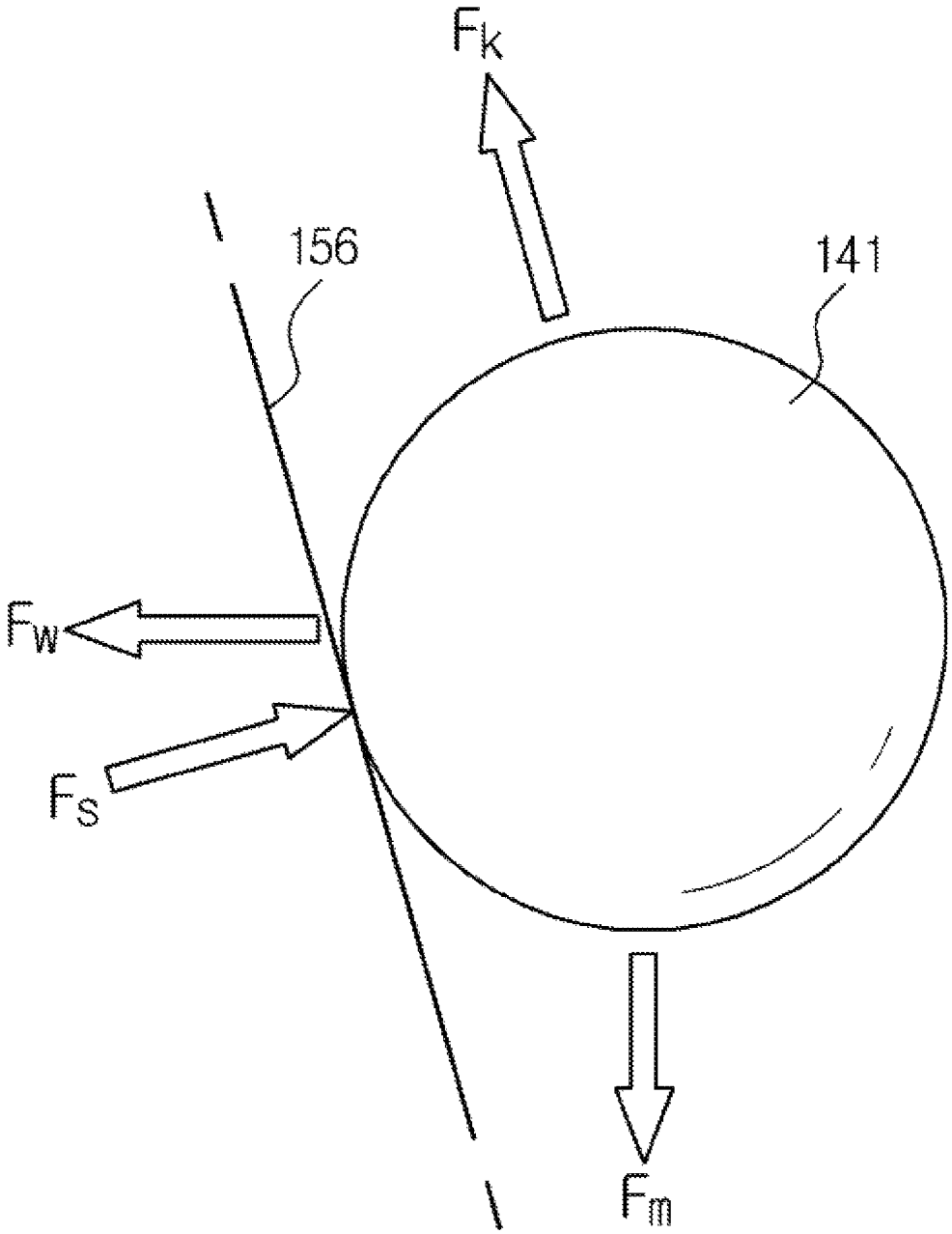
FIG. 14 is a view for explaining a relationship between centrifugal force, magnetic force, and support force by the inclined sidewall.

As shown in FIG. 14, the inclined sidewall 156 generates support force Fs to support each mass 141 in a direction against centrifugal force Fw applied to the mass 141 when the drum 30 rotates.

The centrifugal force Fw applied to the mass 141 when the drum 30 rotates is offset by the support force Fs applied to the mass 141 by the inclined sidewall 156. Accordingly, magnetic force Fm generated by the magnet 160 coupled to the rear surface of the balancer housing 110 offsets only force remaining after being offset by the support force Fs applied to the mass 141 by the inclined sidewall 156 in the centrifugal force Fw of the mass 141, namely force Fk formed along the inclined sidewall 156, and thereby may restrict movement of the mass 141 when the RPM of the drum is within a specific RPM range.

As described above, by forming the inclined sidewall 156 on the second inner surface 111*b* corresponding to the first inner surface 111*a* and offsetting the centrifugal force Fw applied to the mass 141 during rotation of the drum 30 through the inclined sidewall 156, it may be possible to efficiently restrict and control movement of the mass 141 using only the magnetic force Fm of small intensity.

The inclined angle α of the inclined sidewall 156 may be from about 5° to about 25°. The inclined angle α of the inclined sidewall 156 may be changed along the circumferential direction of the second inner surface 111*b*. The inclined angle α of the inclined sidewall 156 may also continuously increase or decrease along the circumferential direction of the second inner surface 111*b*.

As shown in FIG. 10, the inclined sidewall 156 includes first and second sections 156*a* and 156*b* having different inclined angles α1 and α2. The first sections 156*a* are arranged at positions corresponding to the first and second inclined surfaces 154*a* and 154*b*, and the second section 156*b* is arranged between the first sections 156*a*, namely at a position corresponding to the flat surface 154*c* of the groove 150. The inclined angle α1 of the inclined sidewall 156 in each first section 156*a* of the inclined sidewall 156 may be maintained at 25°, and the inclined angle α2 of the inclined sidewall 156 in the second section 156*b* may be maintained between an angle of more than 5° and an angle of less than 25°.

When the inclined angle α of the inclined sidewall 156 is changed, the direction of the support force Fs applied to the mass 141 by the inclined sidewall 156 is changed. Consequently, the direction and size of the force Fk formed along the inclined sidewall 156 are changed. When the inclined angle α of the inclined sidewall 156 is 0°, the centrifugal force Fw of the mass 141 is wholly offset by the support force Fs applied to the mass 141 by the inclined sidewall 156. Consequently, the force Fk formed along the inclined sidewall 156 becomes "0". When the inclined angle α of the inclined sidewall 156 is 90°, the support force Fs becomes "0" and the force Fk formed along the inclined sidewall 156 is maximized. When the inclined angle α of the inclined sidewall 156 is increased between 0° and 90°, the force Fk formed along the inclined sidewall 156 is increased. When the inclined angle α of the inclined sidewall 156 is decreased between 0° and 90°, the force Fk formed along the inclined sidewall 156 is decreased. In addition, the RPM of the drum 30 is proportional to the square of the centrifugal force Fw. Accordingly, when the RPM of the drum 30 is increased, the force Fk formed along the inclined sidewall 156 is increased, whereas, when the RPM of the drum 30 is decreased, the force Fk formed along the inclined sidewall 156 is decreased.

The magnetic force Fm generated by the magnet 160 restricts the mass 141 by offsetting the force Fk formed along the inclined sidewall 156. Accordingly, as the inclined angle α of the inclined sidewall 156 is gradually increased, the Fk formed along the inclined sidewall 156 is gradually increased. Consequently, the mass 141 is decoupled from the groove 150 against the restrictive force by the magnetic force Fm at a relatively low RPM of the drum 30. On the contrary, as the inclined angle α of the inclined sidewall 156 is gradually decreased, the Fk formed along the inclined sidewall 156 is gradually decreased. Therefore, in order for the mass 141 to be decoupled from the groove 150 against the restrictive force by the magnetic force Fm, there is a need for a relatively high RPM of the drum 30.

As described above, the inclined angle of the first section 156*a* is greater than the second section 156*b*. Therefore, among the masses 141 received in the groove 150, the masses 141, which are received on the first inclined surfaces 154*a* of the groove 150 and supported by the first sections 156*a*, are decoupled from the groove 150 at a relatively low RPM of the drum 30, compared with the masses 141 which are received on the flat surface 154*c* of the groove 150 and supported by the second section 156*b*. This means that the masses 141 received in the groove 150 are decoupled from the groove 150 in the order of from the masses 141 disposed at both ends of the groove 150 to the masses 141 disposed at the center of the groove 150 during acceleration of the drum 30. Accordingly, it may be possible to prevent a phenomenon in which the masses 141 received in the groove 150 are not smoothly decoupled from the groove 150 due to being caught in the groove 150 during acceleration of the drum 30.

As shown in FIGS. 3, 8, 9, 10, 11, and 12, the balancer housing 110 is provided, at an inner surface thereof, with a plurality of guide grooves 118*a* and 118*b* which guides movement of the plural masses 141 when the drum 30 rotates. The plural guide grooves 118*a* and 118*b* are formed along the circumferential direction of the balancer housing 110.

The plural guide grooves 118*a* and 118*b* include a first guide groove 118*a* and a second guide 118*b* groove which are disposed to face each other. The first guide groove 118*a* is arranged on the third inner surface 111*c* of the first housing 111 and the second guide groove 118*b* is arranged on the inner surface of the second housing 112. The first guide groove 118*a* is formed by recessing the third inner surface 111*c* and the second guide groove 118*b* is formed by recessing the inner surface of the second housing 112. The first guide groove 118*a* is connected to the groove 150.

The first guide groove 118*a* is disposed outside the second guide groove 118*b* in the radial direction of the balancer housing 110. As shown in FIG. 12, a vertical distance Dg1 between a first line Lg1, which is parallel with the axis Wd of rotation of the drum 30 and passes through a center of the first guide groove 118*a*, and the axis Wd of rotation of the drum 30 is greater than a vertical distance Dg2 between a second line Lg2, which is parallel with the axis Wd of rotation of the drum 30 and passes through a center of the second guide groove 118*b*, and the axis Wd of rotation of the drum 30.

When the drum 30 is accelerated and the RPM of the drum 30 is increased above a given RPM, the masses 141 received in the groove 150 are decoupled from the groove 150 and move along the second guide groove 118*b*. When the drum 30 is further accelerated and the centrifugal force acting on the masses 141 is further increased, the masses 141 move along the first guide groove 118*a* while being tilted toward the second inner surface 111*b* corresponding to the outer peripheral surface 111*e* of the first housing 111. That is, the second guide groove 118*b* serves to guide movement of the masses 141 at relatively low speed and the first guide groove 118*a* serves to guide movement of the masses 141 at relatively high speed.

As such, when the guide grooves 118*a* and 118*b* to guide movement of the masses 141 are formed on the inner surface of the balancer housing 110, it may be possible to reduce friction noise caused by collision between the masses 141 and the inner surface of the balancer housing 110 during rotation of the drum 30 and to prevent a phenomenon in which the inner surface of the balancer housing 110 is damaged by collision with the masses 141. In addition, the thickness of the balancer housing 110 may be reduced to the extent corresponding to a sum of depths of the first and second guide grooves 118*a* and 118*b*, thereby enabling the balancer 100 to be minimized. Moreover, a height Hg of a space between the groove 150 and the inner surface of the second housing 112 may be reduced. Accordingly, it may be possible to prevent a phenomenon in which the masses 141 are not decoupled from the groove 150 due to being caught in the groove 150 by introduction of the masses 141 more than the given number into the groove 150.

Each of the masses 141 is made of a metal material in the form of a sphere. The masses 141 are movably disposed along the annular channel 110*a* in the circumferential direction of the drum 30 so as to offset an unbalanced load within the drum 30 during rotation of the drum 30. When the drum 30 is rotated, the centrifugal force acts on the mass 141 in a radial outward direction of the drum 30. In this state, the mass 141 decoupled from the groove 150 performs a balancing function of the drum 30 while moving along the channel 110*a*.

The masses 141 are received in the first housing 111 before the first and second housings 111 and 112 are bonded to each other. The masses 141 may be received and arranged in the balancer housing 110 through the process of bonding the first and second housings 111 and 112 in a state in which the masses 141 are received in the first housing 111.

A damping fluid 170 is accommodated within the balancer housing 110 so that the mass 141 may be prevented from being suddenly moved.

The damping fluid 170 applies resistance to the mass 141 when the force acts on the mass 141, thereby preventing the mass 141 from being suddenly moved inside the channel 110*a*. The damping fluid 170 may be configured of oil. The damping fluid 170 partially performs a balancing function of the drum 30 together with the mass 141.

The damping fluid 170 is inserted into the first housing 111 together with the masses 141, and is then accommodated inside the balancer housing 110 through the process of bonding the first and second housings 111 and 112. However, the method of accommodating the damping fluid 170 inside the balancer housing 110 is not limited thereto. For example, after the first and second housings 111 and 112 are bonded to each other, the damping fluid 170 may also be accommodated inside the balancer housing 110 by the process of being injected into the balancer housing 110 through an injection hole (not shown) or the like formed on the first or second housing 111 or 112.

Figure 15:
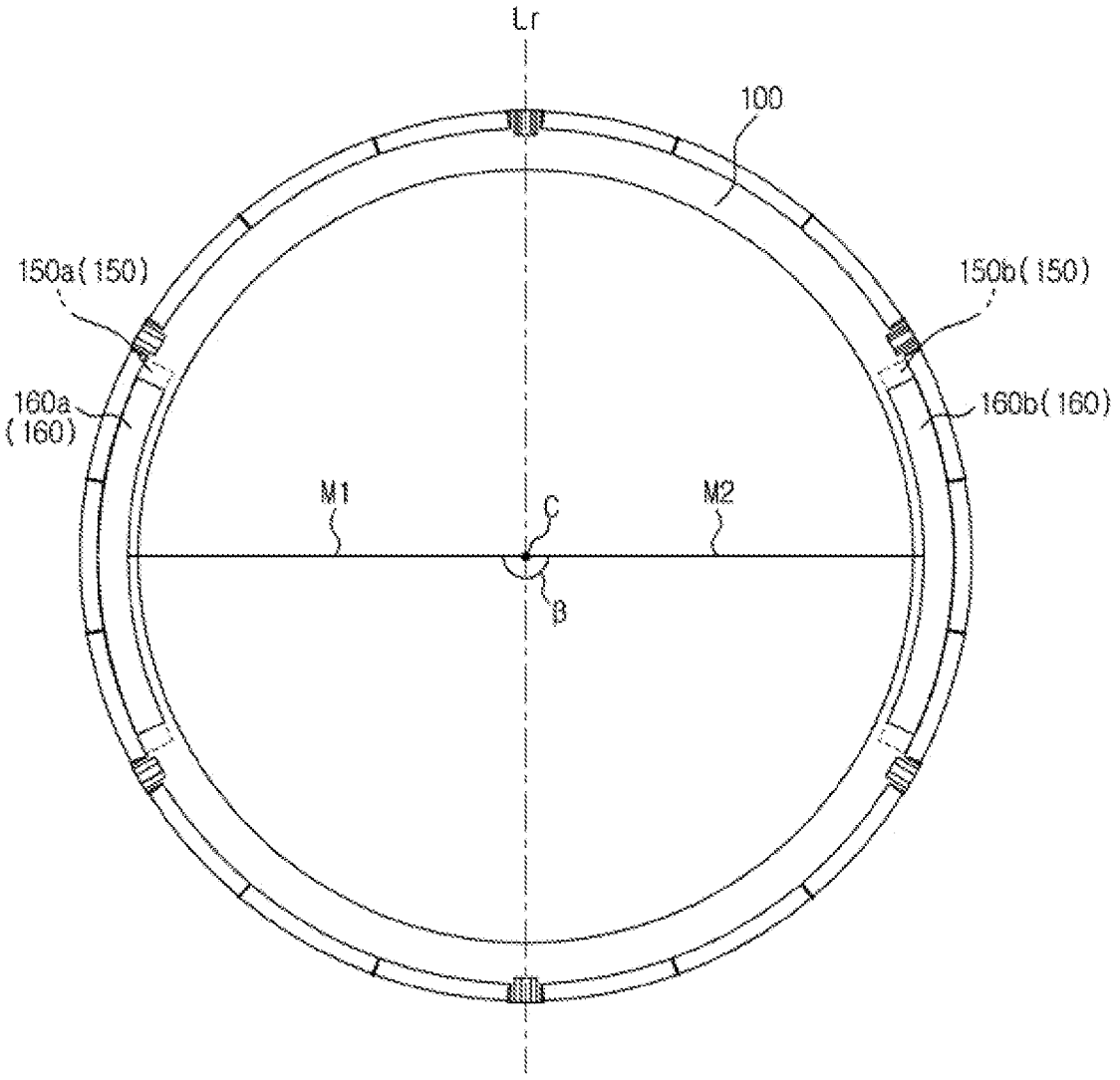
FIG. 15 is a view illustrating a structure in which magnets are arranged on a balancer housing.

FIG. 15 is a view illustrating a structure in which the magnets are arranged on the balancer housing 10. FIG. 15 shows a state of the balancer housing when viewed from the rear.

As shown in FIG. 15, the magnets 160 are disposed at respective positions corresponding to the grooves 150. The magnets 160 include a pair of first and second magnets 160*a* and 160*b* coupled to the rear surface of the balancer housing 110.

The first and second magnets 160*a* and 160*b* may be arranged such that an angle β formed by a first vertical line M1 which vertically connects the first magnet 160*a* and the center C of rotation of the drum 30 and a second vertical line M2 which vertically connects the second magnet 160*b* and the center C of rotation of the drum 30 is from 150° to 210°. In addition, the first and second magnets 160*a* and 160*b* may be arranged such that the angle β formed by the first vertical line M1 and the second vertical line M2 becomes 180°. When the angle β formed by the first vertical line M1 and the second vertical line M2 is 180°, the first and second magnets 160*a* and 160*b* are symmetrically arranged on the basis of the imaginary line Lr which passes through the center of rotation of the drum 30 and is perpendicular to the ground.

As described above, in a case in which the number of the magnets 160 is three or more in a condition that the masses 141 may be restricted by the magnets 160 because the RPM of the drum 30 does not exceed, for example, 200 RPM, when the masses 141 are caught between two adjacent magnets 160 in the process of being restricted, the masses 141 are not moved to the remaining magnets 160. Thus, the masses 141 are not evenly distributed in the balancer housing 110, thereby enabling an unbalanced load to be formed in the drum 30.

In a case in which the pair of magnets 160 are symmetrically arranged on the basis of the imaginary line Lr which passes through the center of rotation of the drum 30, when the masses 141 are wholly received in any one groove 150*a*, a mass 141 which is not received in any one groove 150*a* may be naturally received in the other groove 150*b* and be restricted by the magnets 160 during rotation of the drum 30. Accordingly, a phenomenon in which the masses 141 are not evenly distributed in the balancer housing 110 may not be generated.

Hereinafter, a principle will be described in which the masses 141 are restricted by the groove 150 and the magnet 160 when the RPM of the drum 30 is within a specific RPM range and the masses 141 are decoupled from the groove 150 and perform a balancing function of the drum 30 when the RPM of the drum 30 departs from a specific RPM range.

Figure 16:
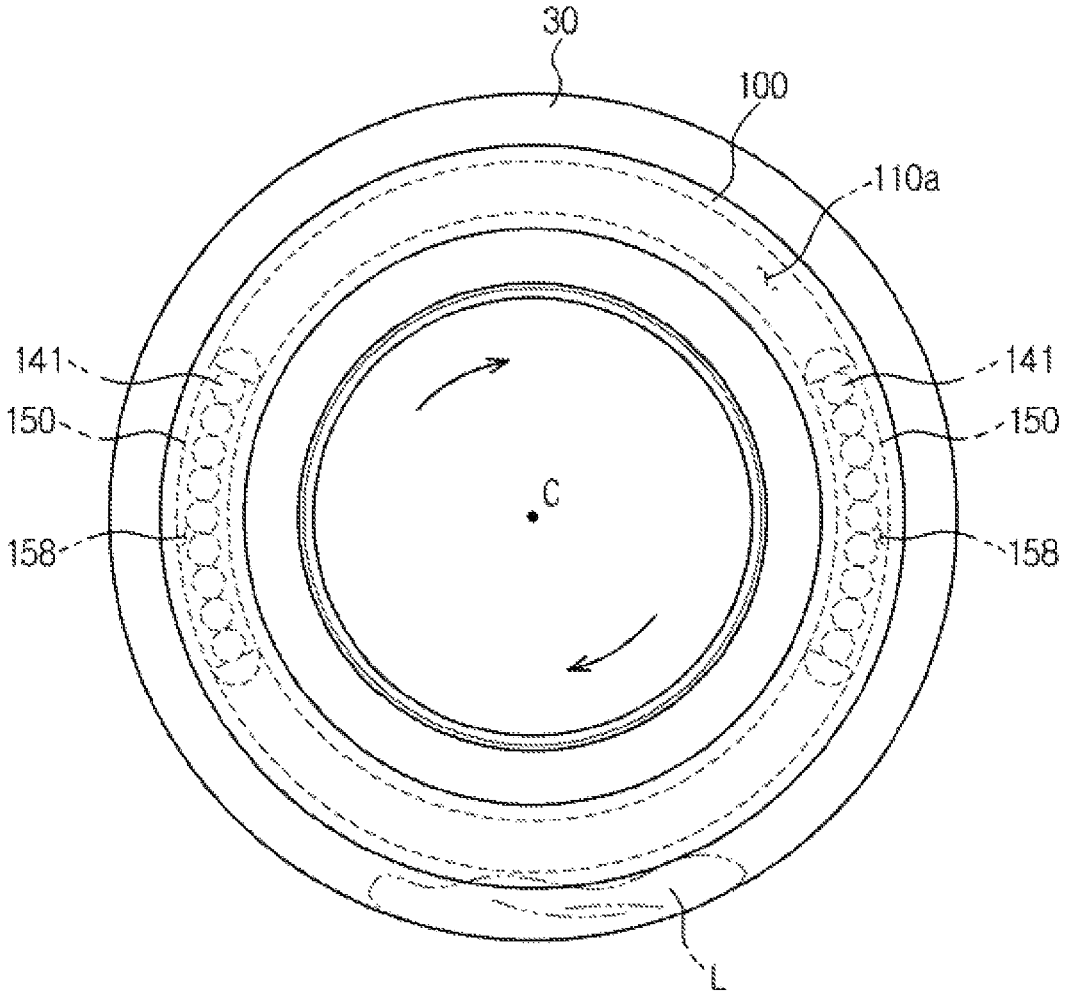
FIGS. 16 and 17 are views illustrating an operation principle of the balancer according to the embodiment of the present invention.
Figure 17:
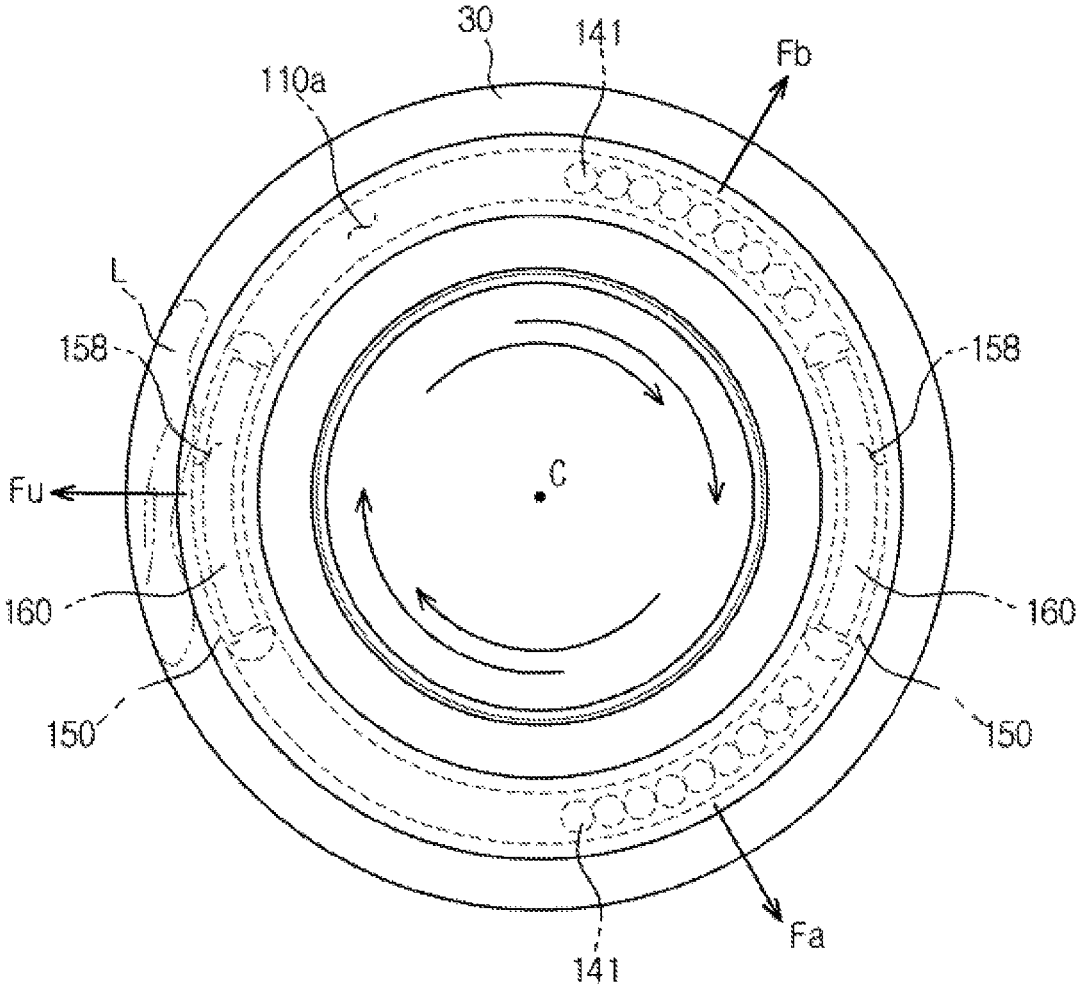

FIGS. 16 and 17 are views illustrating an operation principle of the balancer according to the embodiment of the present invention. The damping fluid 170 is omitted in FIGS. 16 and 17.

As shown in FIG. 16, during initial dehydration of laundry, when the RPM of the drum 30 is within a specific RPM range, the masses 141 are received in the groove 150 or the cross-section increasing portion 158 and movement of the masses 141 is restricted by the magnets 160.

Before dehydration begins, i.e., before the drum 30 begins to rotate, the masses 141 are wholly arranged at the bottom of the balancer housing 110 by weight thereof. In such a state, when dehydration begins and the drum 30 rotates, the centrifugal force acts on the masses 141 so that the masses 141 move along the channel 110*a* of the balancer housing 110 to be received in and seated on the groove 150 in the process of moving along the channel 110*a* of the balancer housing 110. The movement of the masses 141 received in and seated on the groove 150 is restricted by the magnetic force of the magnets 160 until the RPM of the drum 30 does not depart from a specific RPM range. For example, if the washing machine is designed such that the centrifugal force applied to the masses 141 by rotation of the drum 30, the force by weight of the masses 141, the magnetic force by the magnets 160, and the force supporting the masses 141 by the groove 150 balance each other out when the RPM of the drum 30 is 200 RPM, the movement of the masses 141 is restricted in a state in which the masses 141 are received in and seated on the groove 150 when the RPM of the drum 30 is within a range between 0 and 200 RPM during initial dehydration of laundry. Thus, during initial dehydration of laundry, by restricting the movement of the masses 141 when the drum 30 rotates at relatively low speed, it may be possible to prevent a phenomenon in which the masses 141 generate vibration of the drum 30 together with laundry L or the vibration generated by the laundry L is increased. In addition, it may be possible to reduce noise caused by vibration of the drum 30.

As shown in FIG. 17, when the RPM of the drum 30 departs from a specific RPM range, the masses 141 received in and restricted by the groove 150 or the cross-section increasing portion 158 are decoupled from the groove 150 or the cross-section increasing portion 158 and perform a balancing function of the drum 30 while moving along the channel 110*a* of the balancer housing 110.

For example, if the washing machine is designed such that the centrifugal force applied to the masses 141 by rotation of the drum 30, the force by weight of the masses 141, the magnetic force of the magnets 160, and the force supporting the masses 141 by the groove 150 balance each other out when the RPM of the drum 30 is 200 RPM, the centrifugal force applied to the masses 141 is increased when the RPM of the drum 30 exceeds 200 RPM. Therefore, the masses 141 are decoupled from the groove 150 or the cross-section increasing portion 158 and move along the channel 110*a* of the balancer housing 110. In such a process, the masses 141 are controlled so as to move through sliding and rolling toward a position offsetting an unbalanced load Fu caused by the drum 30 due to the bias of the laundry L, namely, in a direction opposite to the direction to which an unbalanced load Fu is applied, thereby generating forces Fa and Fb offsetting the unbalanced load Fu. As a result, it may be possible to stabilize the rotational motion of the drum 30.

As is apparent from the above description, a balancer according to embodiments of the present invention may stabilize rotational motion of a drum by efficiently offsetting an unbalanced load acting on the drum.

In addition, it may be possible to prevent generation of vibration and noise due to a mass for balancing before the drum reaches a specific rotational speed.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A balancer for a washing machine, the balancer comprising:

a circular balancer housing mounted to a drum of the washing machine and having an annular channel therein;

a plurality of masses movably disposed along the channel;

at least one magnet on the balancer housing so as to restrict the masses from moving along the channel when revolutions per minute of the drum are less than or equal to a predetermined revolutions per minute;

at least one groove formed circumferentially on the channel for receiving and restricting the masses from moving along the channel when the revolutions per minute of the drum are less than or equal to the predetermined revolutions per minute; and a single first guide groove formed circumferentially on the channel to guide the plurality of masses around the channel when the drum rotates at revolutions per minute greater than the predetermined revolutions per minute, wherein the groove and the single first guide groove are connected, so that the masses can move from the groove to the first guide groove circumferentially along the channel when the drum rotates at the rotations per minute greater than the predetermined rotations per minute.

2. The balancer according to claim 1, wherein the balancer housing further comprises:

a first housing opened at one side thereof; and a second housing covering the open side of the first housing to form the annular channel between the first and second housings.

3. The balancer according to claim 2, wherein the first guide groove comprises a first guide groove formed on an inner surface of the first housing.

4. The balancer according to claim 3, further comprising: a second guide groove formed on an inner surface of the second housing.

5. The balancer according to claim 4, wherein a vertical distance between a first line, which is parallel with an axis of rotation of the drum and passes through a center of the first guide groove, and the axis of rotation of the drum is greater than a vertical distance between a second line, which is parallel with the axis of rotation of the drum and passes through a center of the second guide groove, and the axis of rotation of the drum.

6. The balancer according to claim 4, wherein the first and second guide grooves are arranged to face each other.

7. The balancer according to claim 3, wherein the balancer housing further comprises:

a first inner surface and a second inner surface which are arranged to face each other; and a third inner surface connecting the first and second inner surfaces, and wherein the first guide groove is formed on the third inner surface.

8. A washing machine comprising:

a cabinet;

a drum rotatably arranged within the cabinet; and a circular balancer mounted to the drum, wherein the balancer comprises:

a balancer housing mounted to the drum;

a plurality of masses movably disposed within the balancer housing;

at least one magnet coupled to the balancer housing so as to restrict the masses when revolutions per minute of the drum are less than or equal to a predetermined revolutions per minute;

at least one groove formed circumferentially on the channel for receiving and restricting the masses from moving along the channel when the revolutions per minute of the drum are less than or equal to the predetermined revolutions per minute; and a single first guide groove formed circumferentially on the channel to guide the plurality of masses around the channel when the drum rotates at revolutions per minute greater than the predetermined revolutions per minute, wherein the groove and the single first guide groove are connected, so that the masses can move from the groove to the first guide groove circumferentially along the channel when the drum rotates at the rotations per minute greater than the predetermined rotations per minute.

9. The washing machine according to claim 8, further comprising a second guide groove formed in the channel, wherein the first and second guide grooves face each other.

10. The washing machine according to claim 9, wherein the first guide groove is disposed outside the second guide groove in a radial direction of the balancer housing.

11. The washing machine according to claim 9, wherein the first guide groove is disposed at a rear of the second guide groove in a direction toward an axis of rotation of the drum.

12. A balancer for a washing machine, the balancer comprising:

a balancer housing mounted to a drum of the washing machine and having an annular channel therein;

a plurality of masses movably disposed along the channel;

at least one magnet on the balancer housing so as to restrict the masses from moving along the channel when revolutions per minute of the drum is less than or equal to a predetermined revolutions per minute; and at least one guide groove on an inside of the balancer housing to guide movement of the plurality of masses when the drum rotates;

a first housing opened at one side thereof; and a second housing covering the open side of the first housing to form the annular channel between the first and second housings, wherein the at least one guide groove comprises a first guide groove formed on an inner surface of the first housing, wherein the at least one guide groove comprises a second guide groove formed on an inner surface of the second housing, and wherein a vertical distance between a first line, which is parallel with an axis of rotation of the drum and passes through a center of the first guide groove, and the axis of rotation of the drum is greater than a vertical distance between a second line, which is parallel with the axis of rotation of the drum and passes through a center of the second guide groove, and the axis of rotation of the drum.

13. The balancer according to claim 12, wherein the first guide groove is formed along a circumferential direction of the balancer housing.

14. The balancer according to claim 12, wherein the second guide groove is formed along a circumferential direction of the balancer housing.

15. The balancer according to claim 12, wherein the first and second guide grooves are arranged to face each other.

16. The balancer according to claim 12, wherein the balancer housing further comprises:

a first inner surface and a second inner surface which are arranged to face each other; and a third inner surface connecting the first and second inner surfaces, and wherein the first guide groove is formed on the third inner surface.

17. A balancer for a washing machine, the balancer comprising:

a circular balancer housing mounted to a drum of the washing machine and having an annular channel therein;

a plurality of masses movably disposed along the channel;

at least one magnet on the balancer housing so as to restrict the masses from moving along the channel when revolutions per minute of the drum are less than or equal to a predetermined revolutions per minute;

at least one guide groove formed circumferentially in an inside wall of the balancer housing to guide the plurality of masses around the circumference of the balancer housing when the drum rotates at revolutions per minute greater than the predetermined revolutions per minute, wherein the balancer housing further includes— a first housing opened at one side thereof, and a second housing covering the open side of the first housing to form the annular channel between the first and second housings, wherein the at least one guide groove includes a first guide groove formed on an inner surface of the first housing, and a second guide groove formed on an inner surface of the second housing, and wherein a vertical distance between a first line, which is parallel with an axis of rotation of the drum and passes through a center of the first guide groove, and the axis of rotation of the drum is greater than a vertical distance between a second line, which is parallel with the axis of rotation of the drum and passes through a center of the second guide groove, and the axis of rotation of the drum.

* * * * *